US006722231B2

(12) United States Patent
Hauk et al.

(10) Patent No.: US 6,722,231 B2
(45) Date of Patent: Apr. 20, 2004

(54) PIPE MAKE/BREAK APPARATUS WITH GRIPPING JAWS AND ADJUSTABLE PIPE SPINNER WITH OILING SYSTEM

(75) Inventors: Thomas D Hauk, Los Alamitos, CA (US); Raul Hector Perez, Hawthorne, CA (US)

(73) Assignee: Hawk Industries, Inc., Long Beach, CA (US)

( * ) Notice: Subject to any disclaimer, the term of this patent is extended or adjusted under 35 U.S.C. 154(b) by 0 days.

(21) Appl. No.: 10/102,544

(22) Filed: Mar. 19, 2002

(65) Prior Publication Data

US 2002/0178871 A1 Dec. 5, 2002

Related U.S. Application Data

(60) Provisional application No. 60/277,075, filed on Mar. 19, 2001.

(51) Int. Cl.[7] ..... B25B 17/00

(52) U.S. Cl. ..... 81/57.16; 81/57.24; 81/57.34

(58) Field of Search ..... 81/52, 54, 57.16, 81/57.19, 57.21, 57.22, 57.24, 57.33, 57.34, 57.36, 57.38, 57.4, 105, 165, 179

(56) References Cited

U.S. PATENT DOCUMENTS

| | | | | |
|---|---|---|---|---|
| 4,604,922 A | * | 8/1986 | Soutsos | 81/57.17 |
| 4,774,860 A | * | 10/1988 | Hawke | 81/57.17 |
| 4,776,243 A | * | 10/1988 | Schulze-Beckinghausen et al. | 81/57.44 |
| 4,843,924 A | | 7/1989 | Hauk | |
| 5,060,542 A | | 10/1991 | Hauk | |
| 5,386,746 A | | 2/1995 | Hauk | |
| 5,868,045 A | | 2/1999 | Hauk | |
| 6,206,096 B1 | * | 3/2001 | Belik | 166/77.51 |
| 6,334,376 B1 | * | 1/2002 | Torres | 81/372 |
| 6,460,634 B1 | * | 10/2002 | Hart et al. | 175/85 |
| 6,505,531 B2 | * | 1/2003 | Stogner | 81/57.16 |

OTHER PUBLICATIONS

Hawkjaw Operation, Maintenance and Service Manual Model 65K–MA, published Apr. 1997, pp. 1–137, USA.

Hawkjaw Operation Maintenance and Service Manual Model 100K–ALS, Rev 12.99.92.00, published circa 12/99, pp. 1–159, USA.

* cited by examiner

*Primary Examiner*—Joseph J. Hail, III
*Assistant Examiner*—David B. Thomas
(74) *Attorney, Agent, or Firm*—Squire, Sanders & Dempsey, L.L.P.

(57) ABSTRACT

A pipe making and breaking apparatus having top, middle and bottom wrenches connected to a frame. A torquing cylinder operatively extends between the middle wrench and the frame and when actuated through one or more torquing cycles causes an upper pipe to make (top and middle wrenches) or break (middle and bottom wrenches) relative to a lower pipe. A grip hold actuator maintains the middle wrench in the gripping position continuously during the making torquing cycles. A continuous chain spinner above the top wrench spins the top pipe to make a position or away from a make position. The spinner can be a stand alone unit or can hang freely in the derrick or can be part of the make/break apparatus. A spinner drive chain motor when pressurized and when an oiler button is actuated causes lubricant to be sprayed out a nozzle on the (moving) chain. Windows (guide gates) and/or guide posts direct the chain so as to not bunch up against the casing sprockets.

156 Claims, 34 Drawing Sheets

PIPE MAKE/BREAK APPARATUS WITH GRIPPING JAWS AND ADJUSTABLE PIPE SPINNER WITH OILING SYSTEM

CROSS-REFERENCE TO RELATED APPLICATION

This application claims the benefit of U.S. Provisional Application No. 60/277,075 filed Mar. 19, 2001, whose entire contents are hereby incorporated by reference.

BACKGROUND OF THE INVENTION

The present invention relates to apparatuses and methods for making (torquing up the connection) and/or breaking (breaking out the connection) joints in drill pipe strings, including systems for spinning pipes (up to the shoulder or to refusal such as for tapered connections).

A number of apparatuses or machines for making and breaking joints in drill pipe strings are known. A superior and commercially successful machine is the HAWKJAW apparatus available from Hawk Industries of Long Beach, Calif. Versions of it are described in U.S. Pat. Nos. 5,060,542 (Hauk), 5,386,746 (Hauk), and 5,868,045 (Hauk). The HAWKJAW apparatus (or machine or power tong) including both the HAWKJAW JR. and SR. models, are disclosed in the "HAWKJAW Operation, Maintenance and Service Manual" (Model 100K-ALS-REV 12,99.9200) and "HAWKJAW Operation, Maintenance and Service Manual, Model 65K-ALS, June 2000." (The above-mentioned patents and publications and all other patents and publications mentioned anywhere in this disclosure are hereby incorporated by reference in their entireties.)

Basically, the HAWKJAW apparatus includes a structural frame supporting three wrenches (or jaws or grippers) aligned one on top of the other. The top and bottom wrenches are in the same orientation, and the middle wrench is in a flipped over orientation. Each of the jaws is operated in only one direction and is self-energizing. The HAWKJAW apparatus uniquely allows the drill pipe string to be made up (torqued up) and to be broken out using the same machine and without having to reposition the wrenches relative to the frame for the different operations. Further, a spinner can be provided at the top of the frame to spin the top pipe section out of the drill pipe string once the wrenches have broken the joint connection. In other words, the HAWKJAW apparatus is a device to connect and disconnect drill pipe on the rig floor while tripping, and/or to make and break other connections on the drill rig floor, including small, big and short connections. It is a versatile system. The spinner spins the connection to the shoulder so that the wrenches can take over and torque it up. And, after the connection has been subsequently broken by the wrenches, the spinner can spin it out at low torques to disconnect it.

On the make-up cycle of the HAWKJAW apparatus the structural frame moves about the centerline of the drill pipe string, approximately fifty degrees. This movement is due to the fact that the middle wrench is gripped on the bottom section of the drill pipe string that is rigid to the well. The torque cylinder is hooked to the middle wrench that is gripped on the bottom connection. The top wrench is gripped on the top connection and must turn, and is part of the infrastructure of the HAWKJAW apparatus. As the middle wrench is gripped, it stays rigid on the bottom connection, and the HAWKJAW apparatus (or more specifically the structural frame thereof) which is gripped on the top connection, rotates as the drill pipe is making up. The bottom section of the pipe is not moving; it can be generally 6,000 to 10,000 or so feet below it and thus is rigid in the derrick and does not turn. The only thing that turns is the top connection of the drill pipe string.

When the drill pipe string is being made up, the top connection is rotated clockwise as viewed from above. The torque cylinder rod end is rotatably hooked to the middle wrench, and the body end trunnion is rotatably hooked to the top and bottom wrench frame. As stated above, the top and bottom wrenches are oriented in the same direction, while the middle wrench is flipped over upside down and rotated in the opposite direction.

The torquing load is placed on the middle wrench and either the top or bottom wrench by the hydraulic torque cylinder. Thus, in the making-up operation the middle wrench is connected to the bottom section of the pipe, which is fixed, and with the torque applied between the structural frame of the HAWKJAW apparatus and the fixed middle wrench, the structural frame with the top wrench connected thereto rotates about the centerline of the drill pipe string. In contrast, in the break-out operation the middle wrench is connected to the upper pipe section and the bottom wrench is connected to the lower pipe section. The torquing cylinder applies a load between the middle and bottom wrenches and the middle wrench turns the upper pipe section. The structural frame does not thereby rotate around the centerline of the drill pipe string.

If a torque extension does not completely torque one pipe relative to the other, it is then necessary to torque the apparatus again. This means that when the first torque extension is complete, the apparatus comes off of the pipe; and because it is hung rearward of the pipe it will swing back to its normal free hanging position. The workmen then must push the apparatus back onto the pipe and again initiate the gripping and torquing procedures. This is time consuming, labor intensive and potentially dangerous.

The need for additional torque cycles to properly torque the connection for the drill pipe is especially significant with the HYDRIL pipe which has a wedge thread, providing a tapered drill pipe connection for the joint tool connection. Thus, as the two pieces of pipe are screwed together, the interference fit therebetween becomes progressively tighter. It takes more than fifty degrees to torque this wedge-type thread and more particularly, takes anywhere from one hundred and fifty to one hundred and seventy-five or two hundred degrees to torque the connection out. In contrast, a normal connection needs a torque of thirty-five to forty degrees to make up. Thus, three to six time-consuming grip-torque-release cycles are required to make the HYDRIL pipe with the prior art HAWKJAW apparatus.

Also known in the prior art are different devices for spinning or rotating one pipe relative to another during the making or breaking of the threaded connection between them. An example of a commercially successful product is the SPINMASTER spinner also available from Hawk Industries. The SPINMASTER series of pipe spinners is available in air and hydraulic models, and include a unique gripping system. An example is the SPINMASTER Model 550/950 series, which is easy to maintain since it includes external mounted bearings with removable caps, cylinders pinned in position for simple removal and repair, and few moving parts. Another feature thereof is the high torque output because of the scissor case design with perpendicular mounted cylinders which increase the gripping force and because there is essentially no chain slippage. The chain is a heavy-duty, durable roller-type chain. The compact light design of this spinner makes it easy to be handled on the floor reducing crew fatigue. The basic function and construction of the SPINMASTER spinner are disclosed in U.S. Pat. No. 4,843,924 (Hauk).

The chain for the spinner is periodically lubricated by the workmen by brushing it with grease. This is an ineffective lubricating method, however, since the grease does not get on the insides of the pins and the chains. Additionally, it is a separate labor step and the workmen may forget or procrastinate doing it. And it is especially important to keep the chain oiled in today's drilling environments, which are frequently subject to corroding salt water air. The linkages if not oiled will wear and rust quickly and bind.

SUMMARY OF THE INVENTION

Many of the inventions herein are directed to remedying the problems discussed above. The pipe making and breaking apparatus disclosed herein preferably includes three pipe gripping wrenches, as described the HAWKJAW apparatus above and incorporated in this invention summary. When the apparatus is in the "make" mode the middle wrench is gripped on the bottom pipe section and the top wrench is gripped on the top section, and when in the "break" mode the bottom wrench is on the bottom section and the middle wrench is on the top pipe. (Alternatively, the middle and top wrenches can be mirror images of the orientations as disclosed herein and the middle wrench can be flipped over compared to the orientation disclosed. Then the middle and top wrenches will be used for break and the middle and bottom for make.) A novel "grip hold" function is provided by the present invention such that when a detented grip hold button (or the like) is pushed, as by the machine's operator, to its "on" position the wrench on the bottom pipe section remains gripped during the number of needed torquing operations of the wrench on the upper pipe section, because of a unique pneumatic/hydraulic system. The grip hold button (or lever, switch or other type of actuator) when actuated holds the bottom wrench on the break cycle and the middle wrench in the make cycle. The grip button holds the middle wrench on the break cycle and the top wrench on the make cycle. When the grip hold button is de-energized, the grip button is rendered inoperative.

The chain spinner, which can be part of this make/break apparatus or a separate unit, includes a unique chain oiler system. The spinner for example can be a free hanging, separate stand alone unit. The chain oiler is powered by fluid passing through the spinner motor. When the spray button is pressed the nozzle sprays hydraulic fluid onto the moving chain. The oil can thus only be sprayed when the spinner motor is turning and the chain is moving. Additionally, a chain guide is provided for the spinner chain to prevent the chain from bunching up and catching on the sprockets, which is a serious problem in the prior art. This chain guide is another invention disclosed herein. These chain oilers and guides can be adapted to fit on today's spinners including the SPINMASTER spinner.

Other objects and advantages of the present invention will become more apparent to those persons having ordinary skill in the art to which the present invention pertains from the foregoing description taken in conjunction with the accompanying drawings.

DETAILED DESCRIPTION OF PREFERRED EMBODIMENTS OF THE INVENTION

Figure 1:
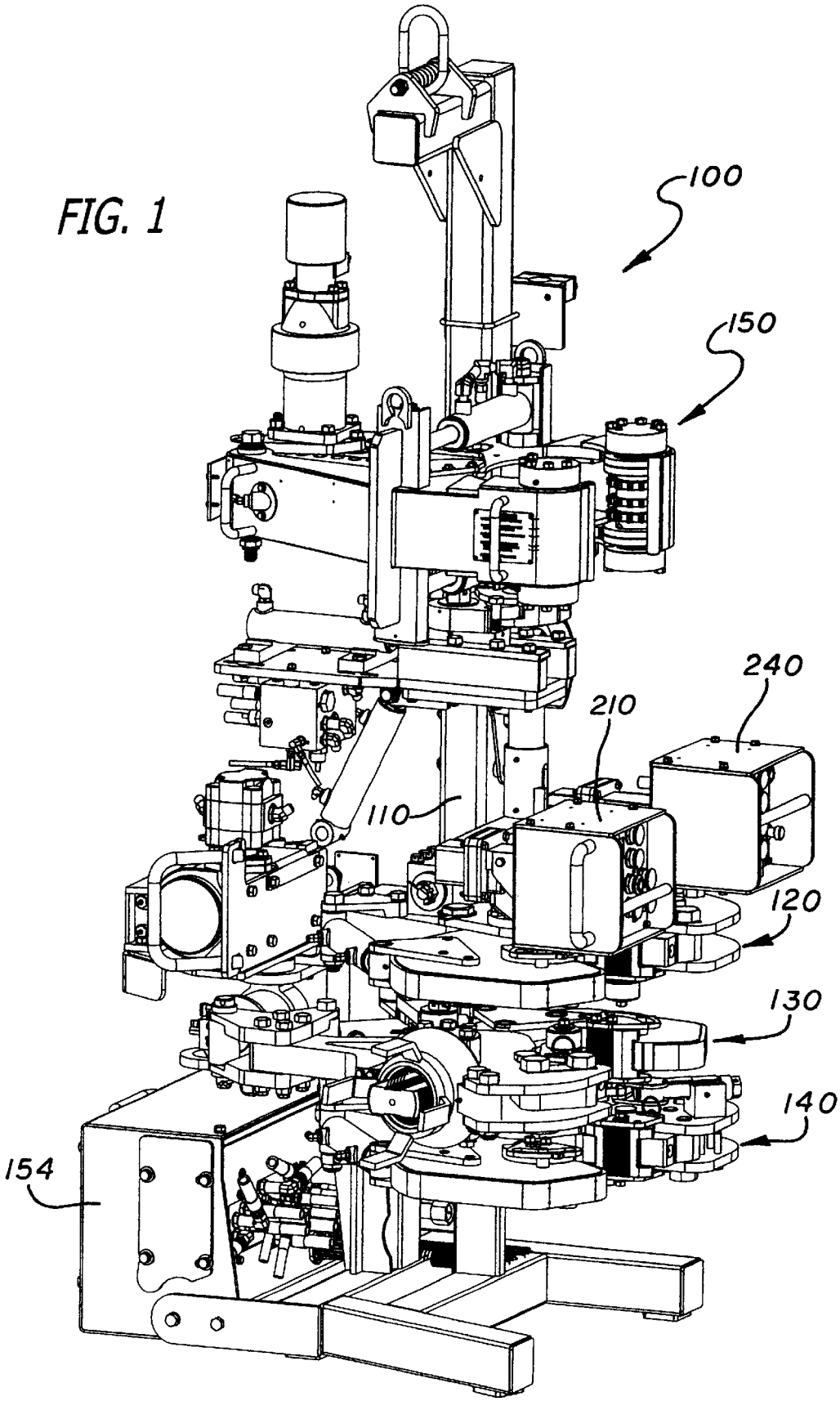
FIG. 1 is a perspective view of a pipe making and breaking (and spinning) apparatus of the present invention.

The pipe make/break apparatus of the invention is shown generally at 100 in FIG. 1 and is essentially an adaptation of the previously-described HAWKJAW apparatus. It includes a structural frame 110, a top wrench 120, a middle wrench 130, a bottom wrench 140, a spinner assembly 150 at the top and a hydraulic block 154 at the rear bottom.

The hydraulic system as depicted in FIGS. 7*a*–7*d* for the apparatus of FIG. 1, like a typical hydraulic system, has a pressure source or a flow source 160, a tank 170 for the excess oil that comes back, and a pump 180 that pumps the oil through the system. This system is essentially a closed system, with the exception of the chain oiler 190, as will described later. The hydraulic pump 180 preferably is a thirty-three gpm at 2,600 psi, which is about forty horsepower. An electrical motor 186 attached to the pump energizes the pump to pump the fluid. The air supply source 200 is preferably from the drilling rig and has a typical pressure of about one hundred psi.

Figure 6:
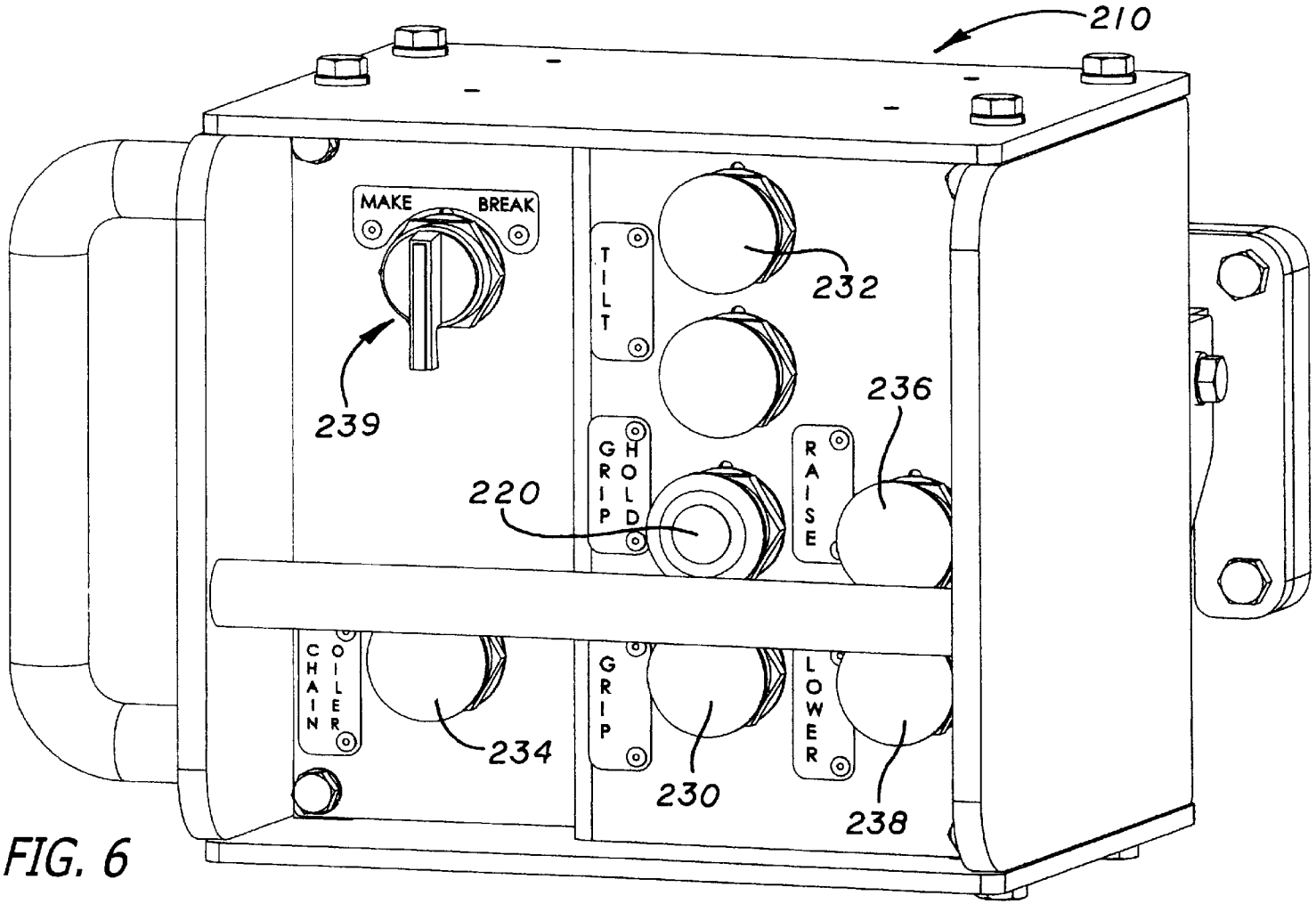
FIG. 6 is an enlarged perspective view of the left control box of the apparatus of FIG. 1.
Figure 7:
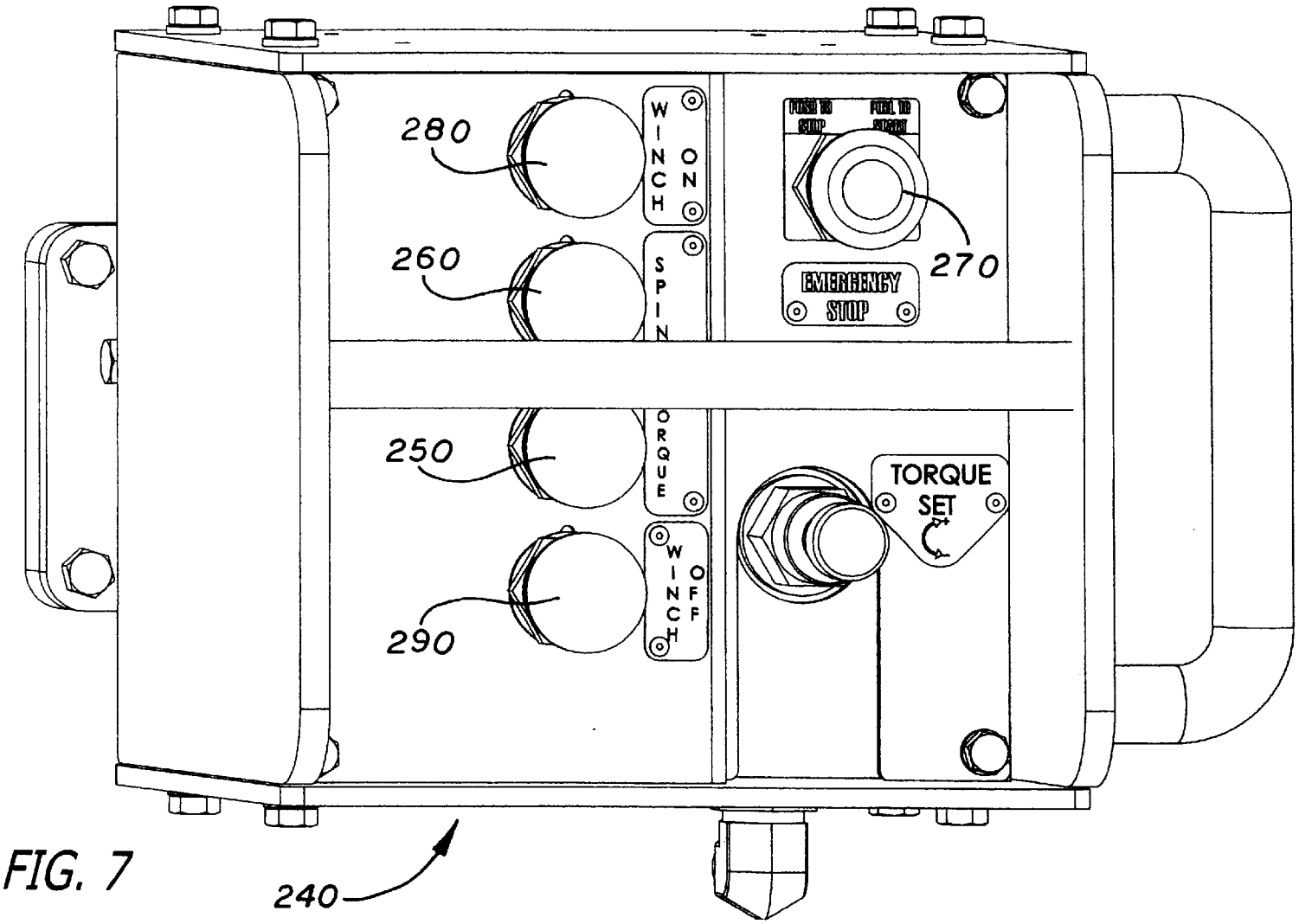
FIG. 7 is an enlarged perspective view of the right control box of the apparatus of FIG. 1.
Figure 8A:
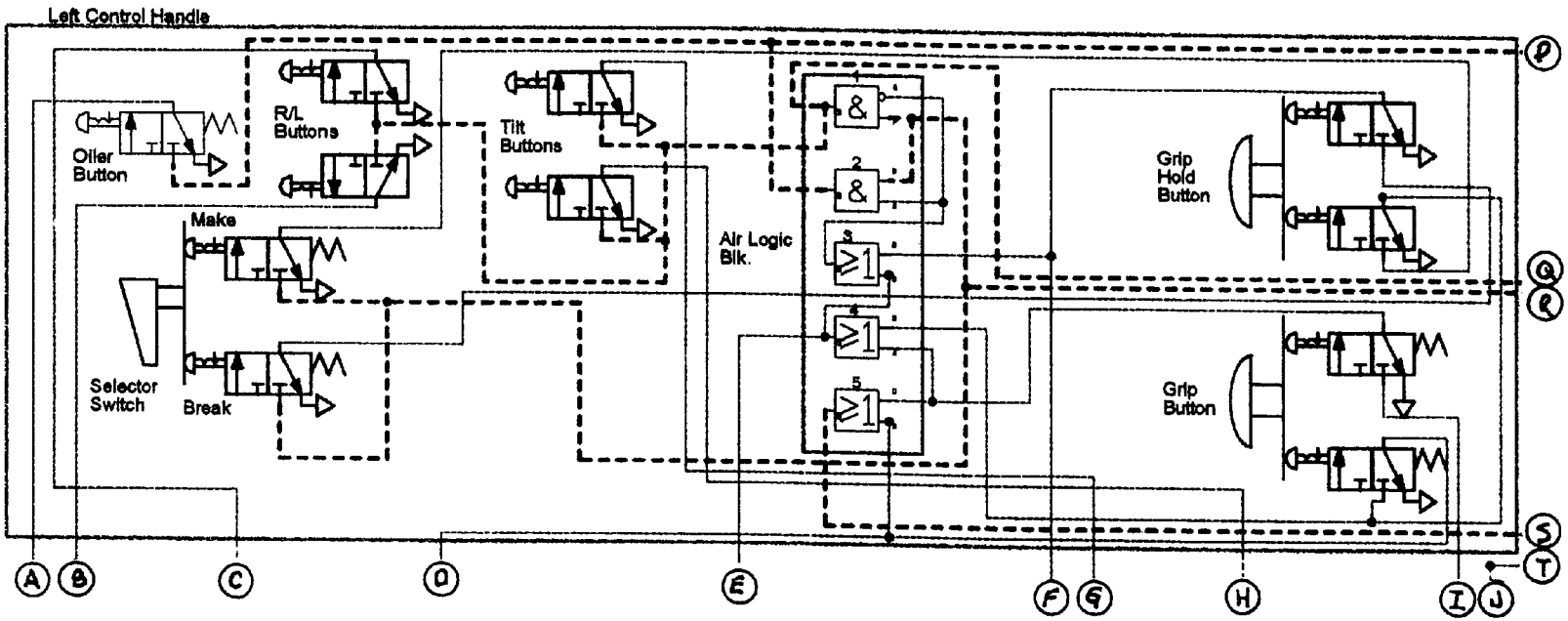
FIGS. 8*a* through 8*d* show the hydraulic and pneumatic circuit of the apparatus of FIG. 1.
Figure 8B:
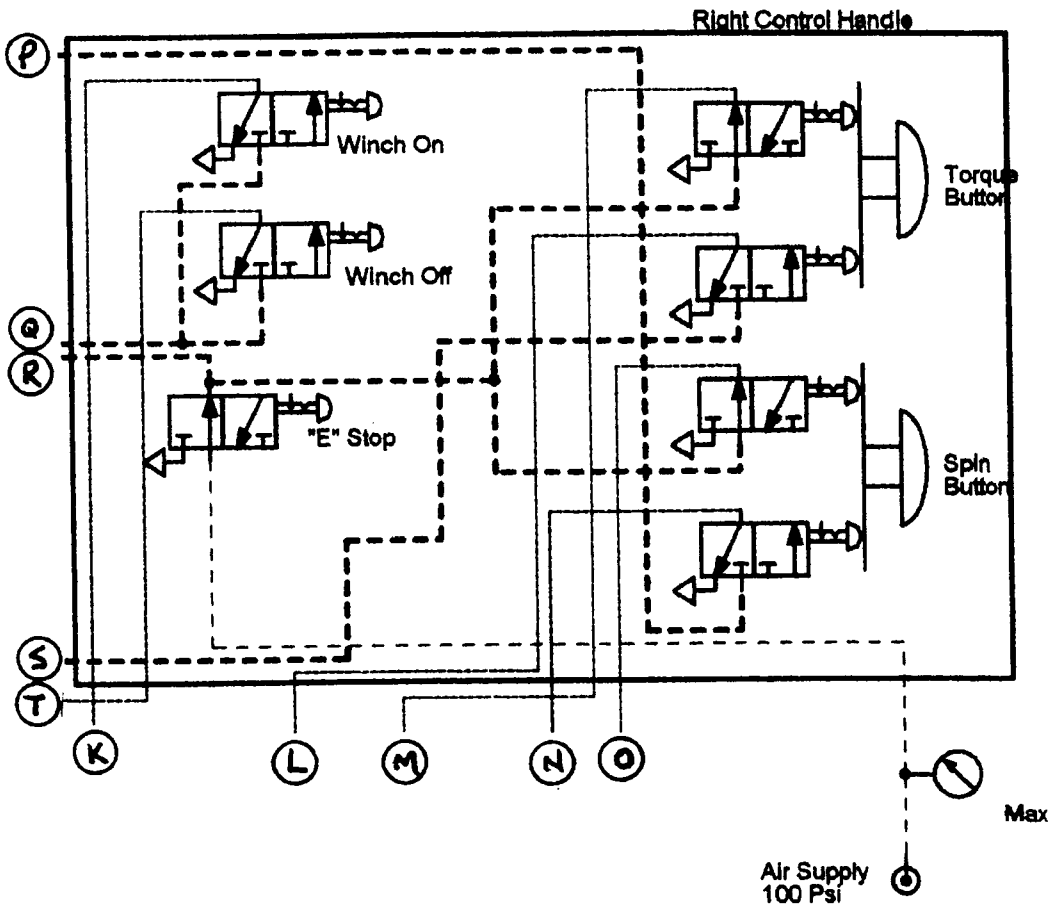
Figure 8C:
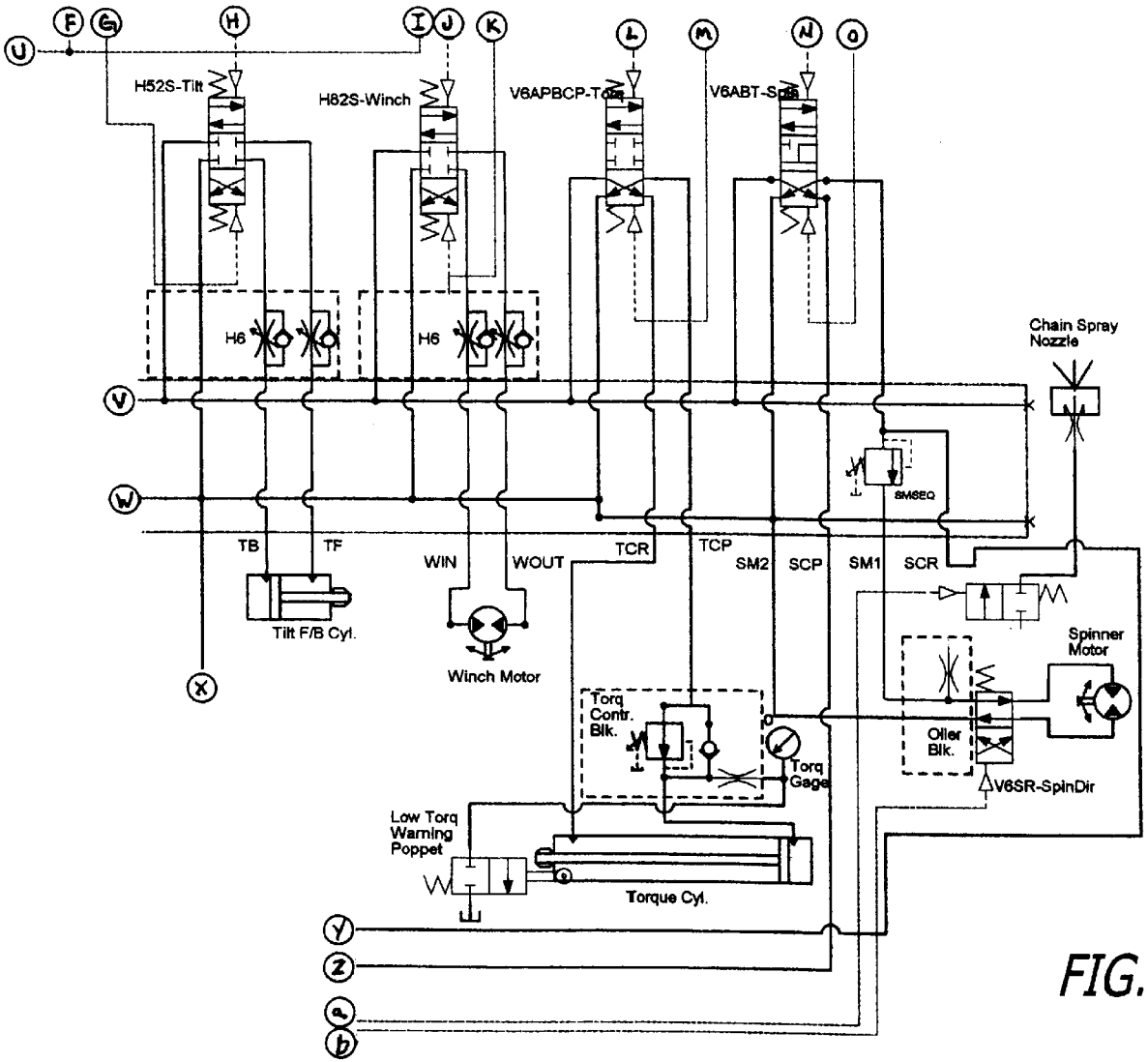
Figure 8D:
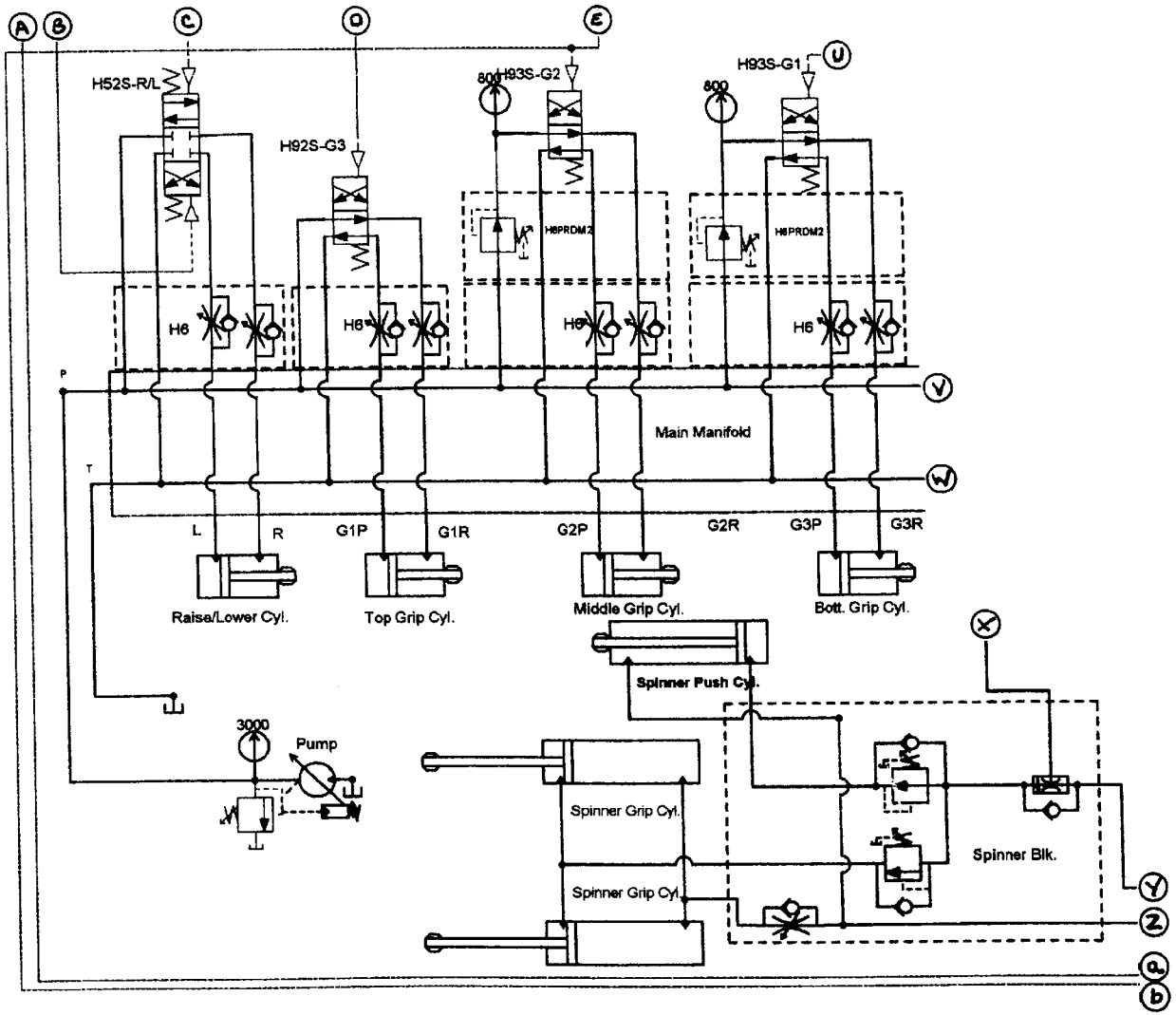
Figure 9A:
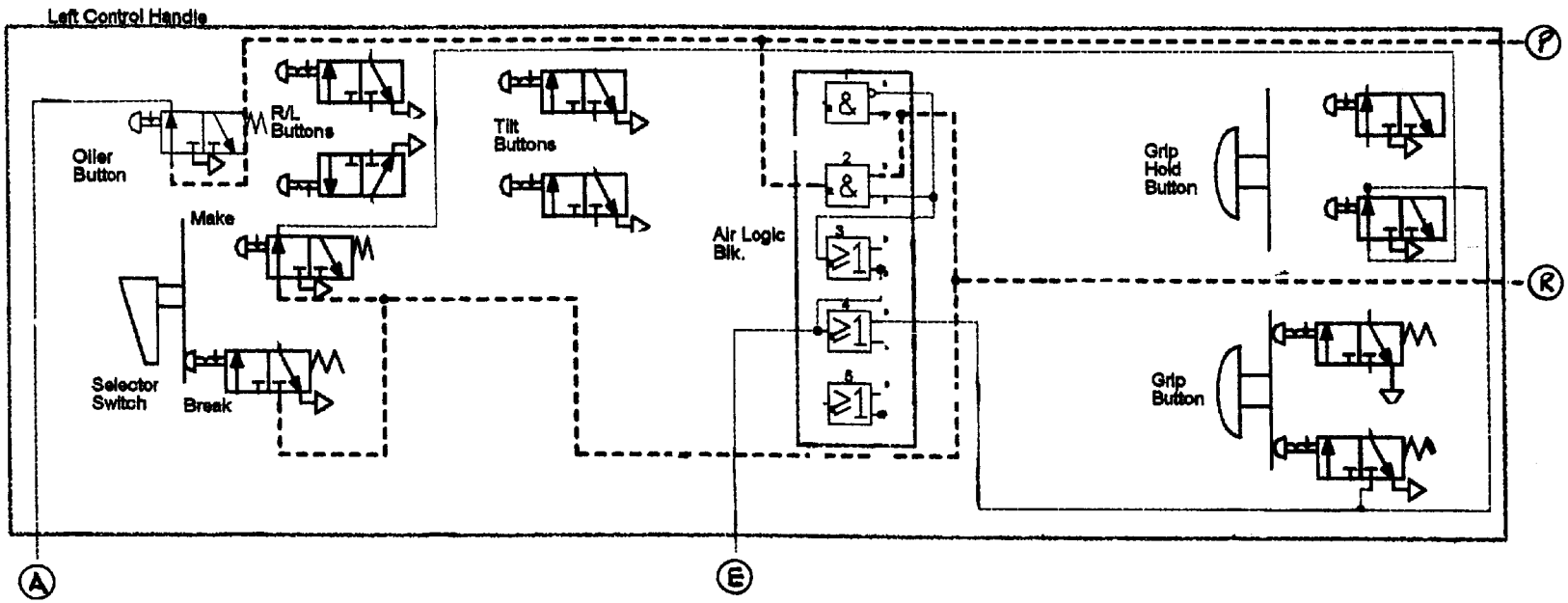
FIGS. 9*a* through 9*d* show the operational components of the chain oiler features of the circuit.
Figure 9B:
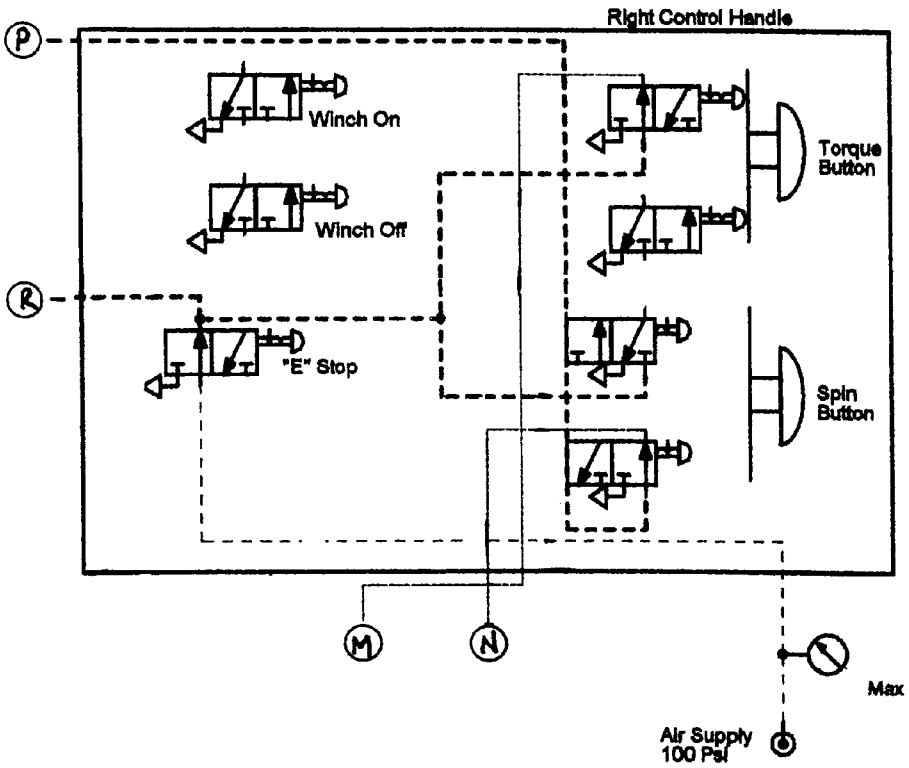
Figure 9C:
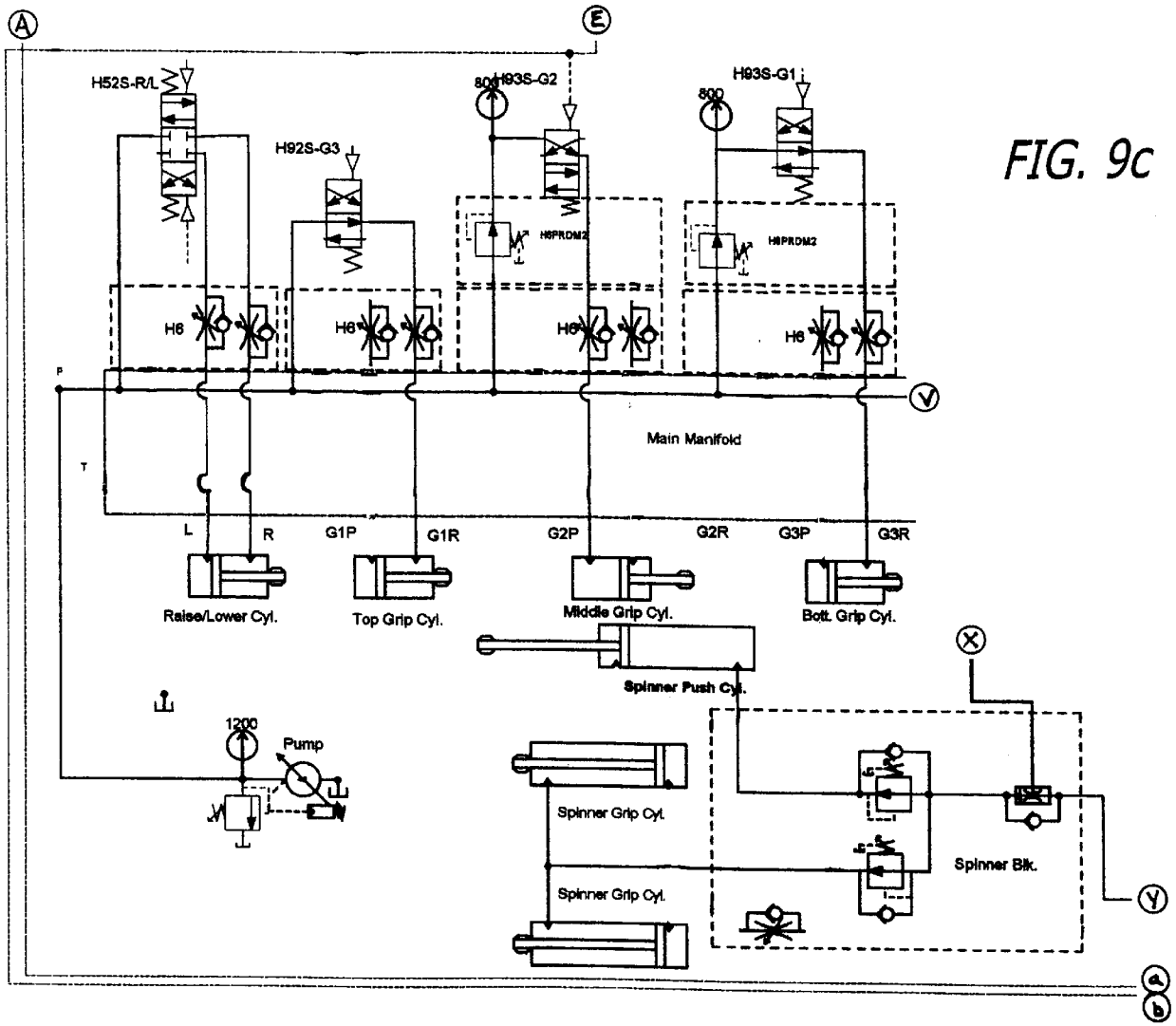
Figure 9D:
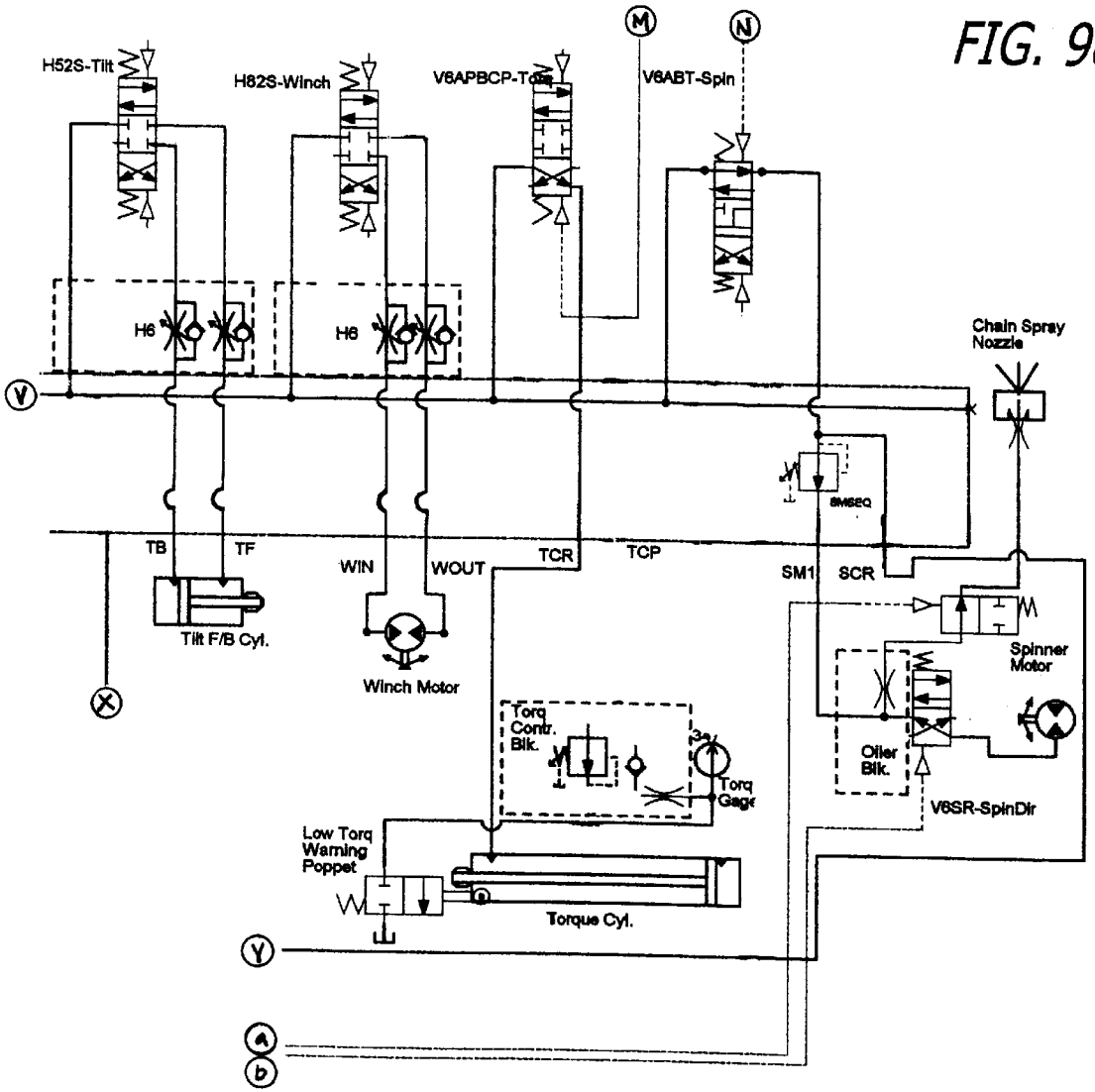
Figure 10A:
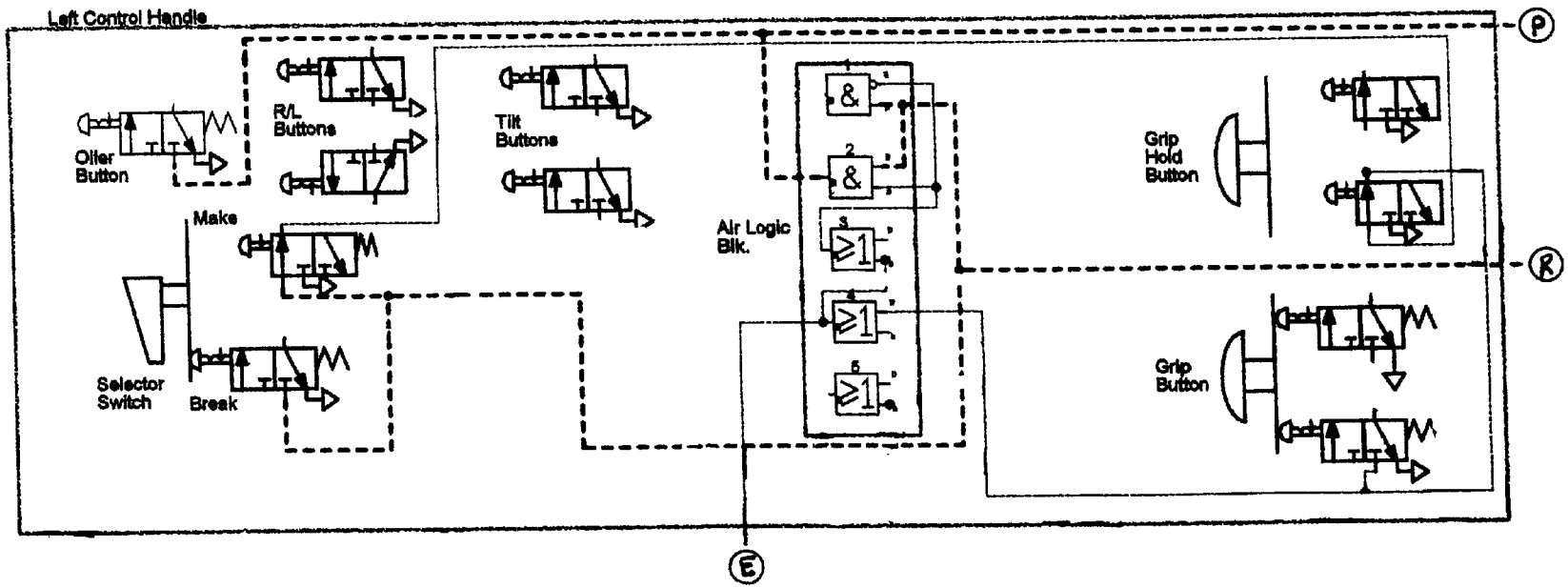
FIGS. 10*a* through 10*d* show the no-torque without grip and grip hold features of the circuit.
Figure 10B:
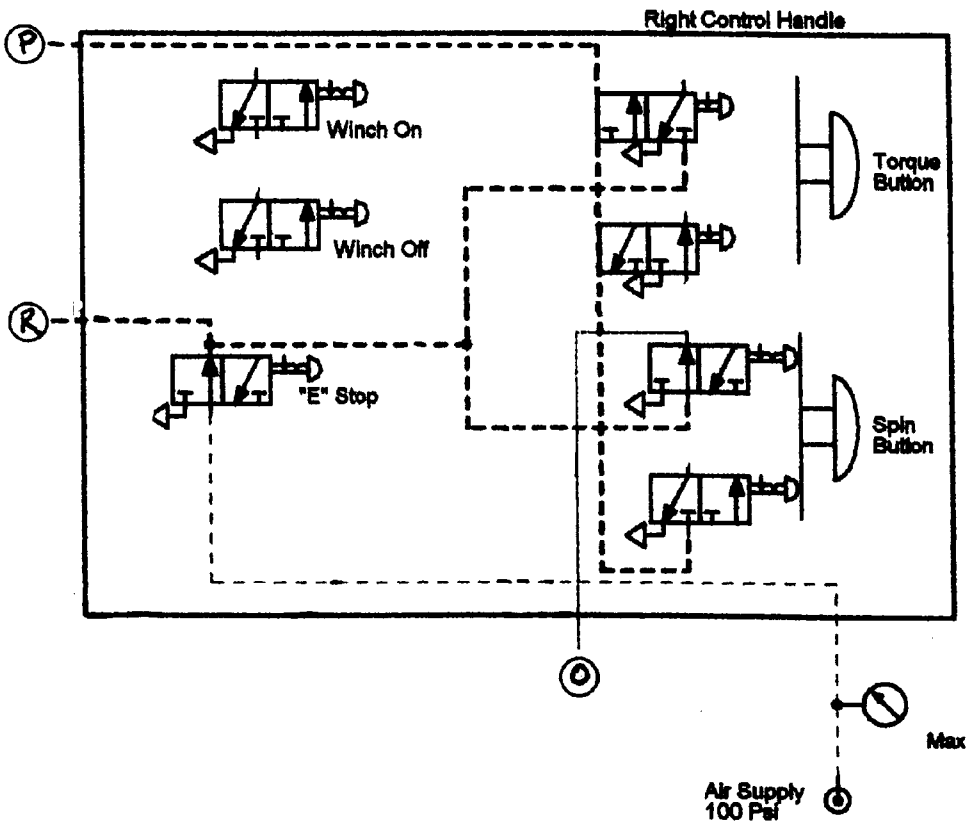
Figure 10C:
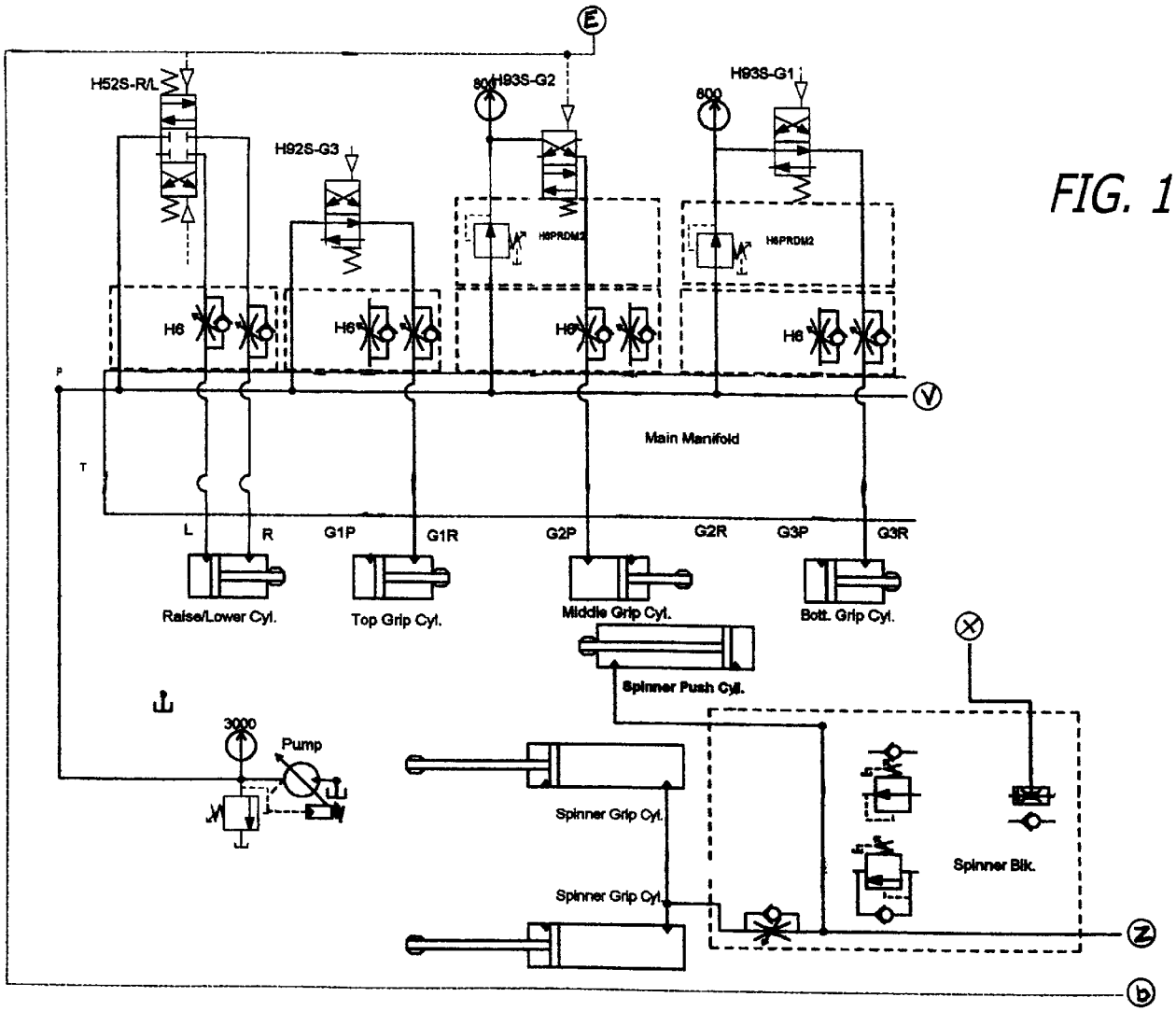
Figure 10D:
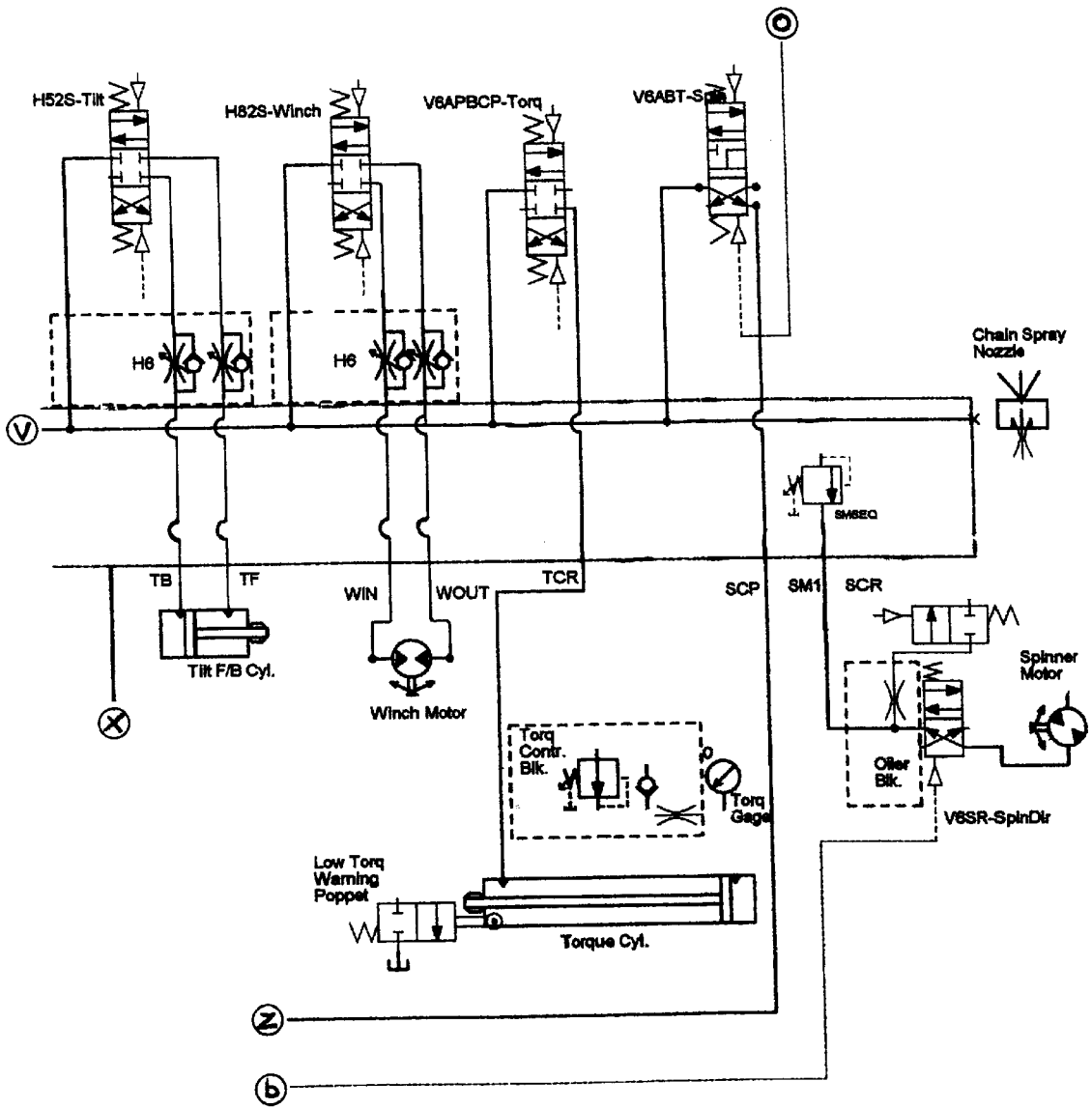
Figure 11A:
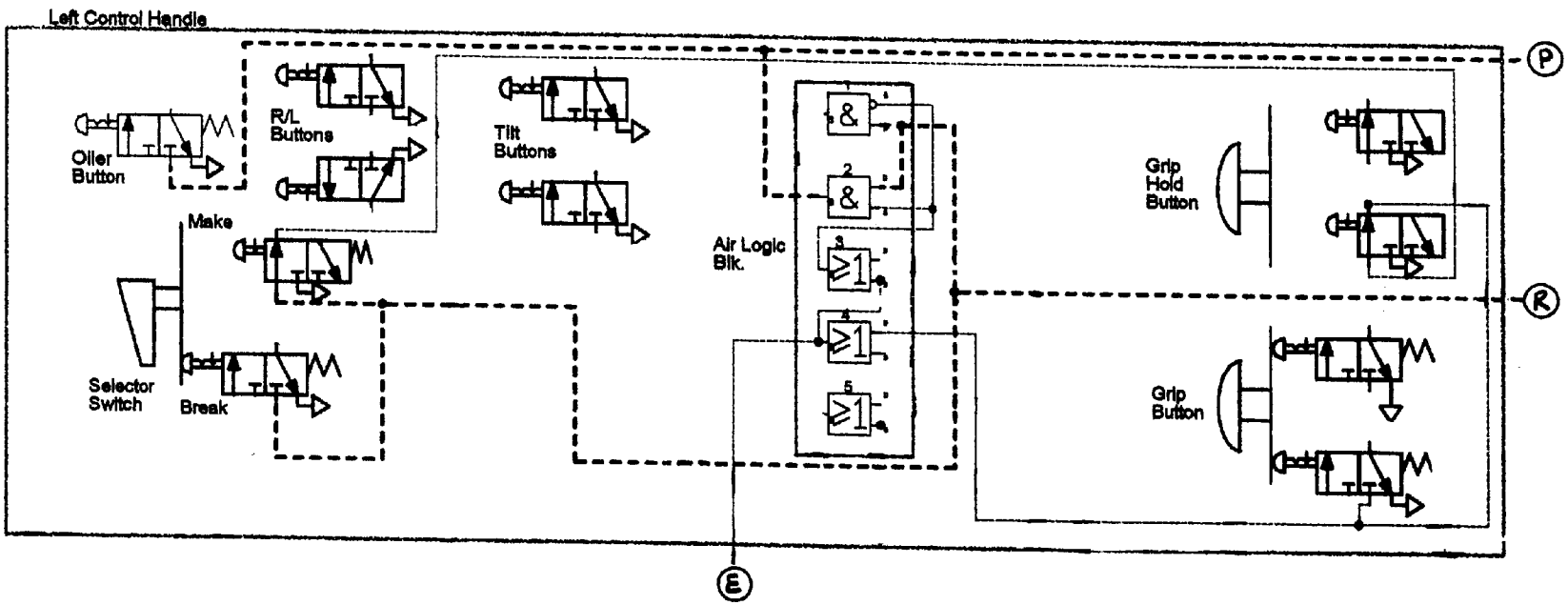
FIGS. 11*a* through 11*d* show the grip hold disabling right and left lift, tilt and winch features of the circuit.
Figure 11B:
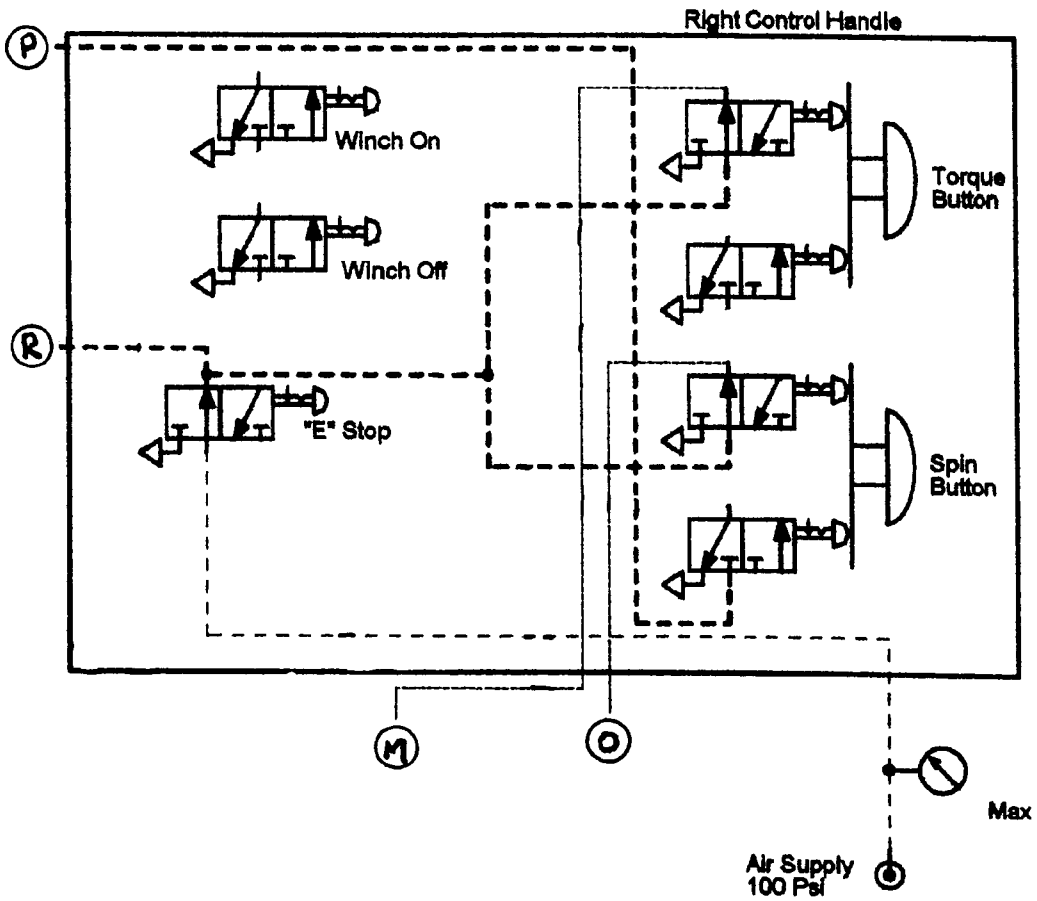
Figure 11C:
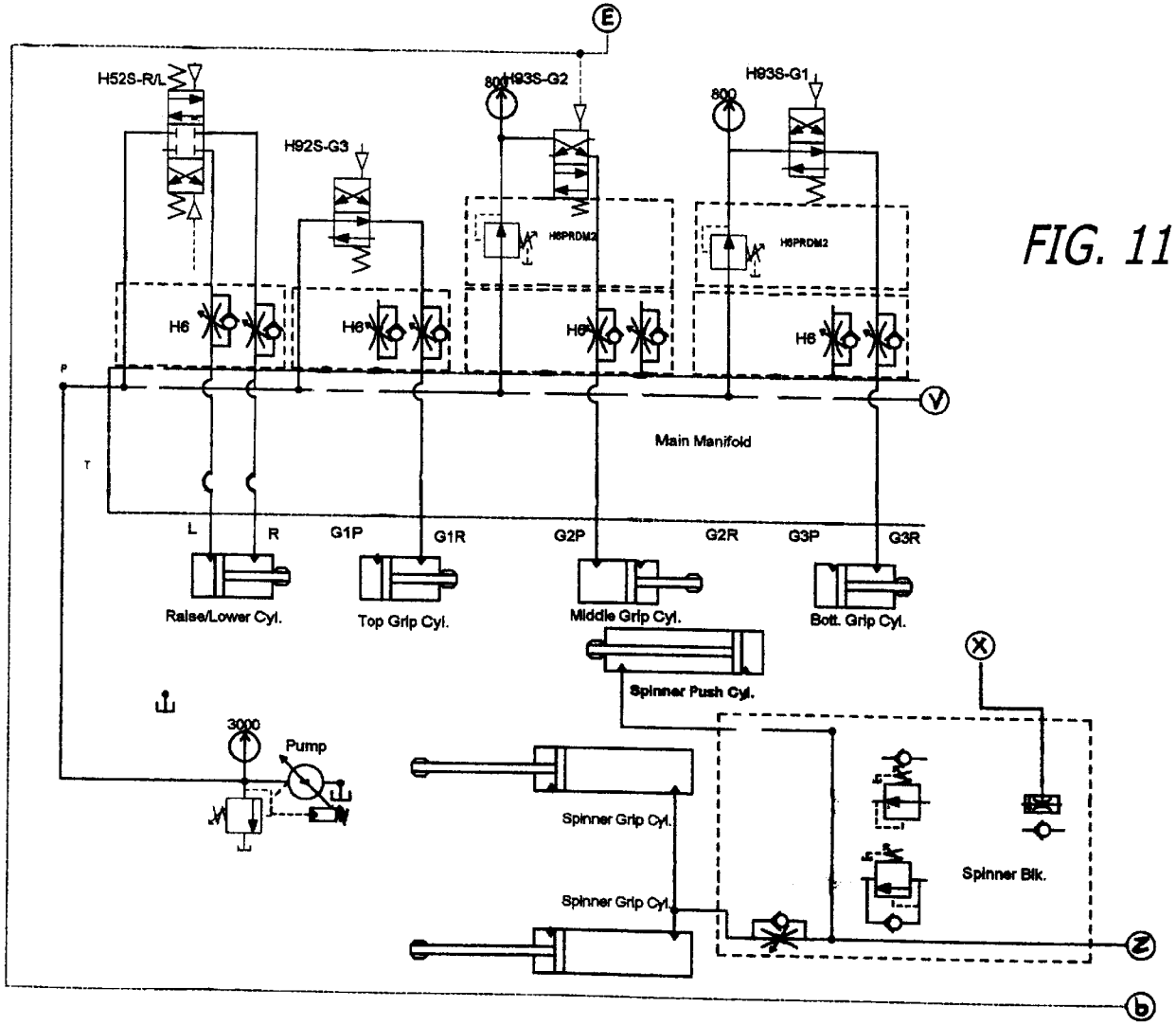
Figure 11D:
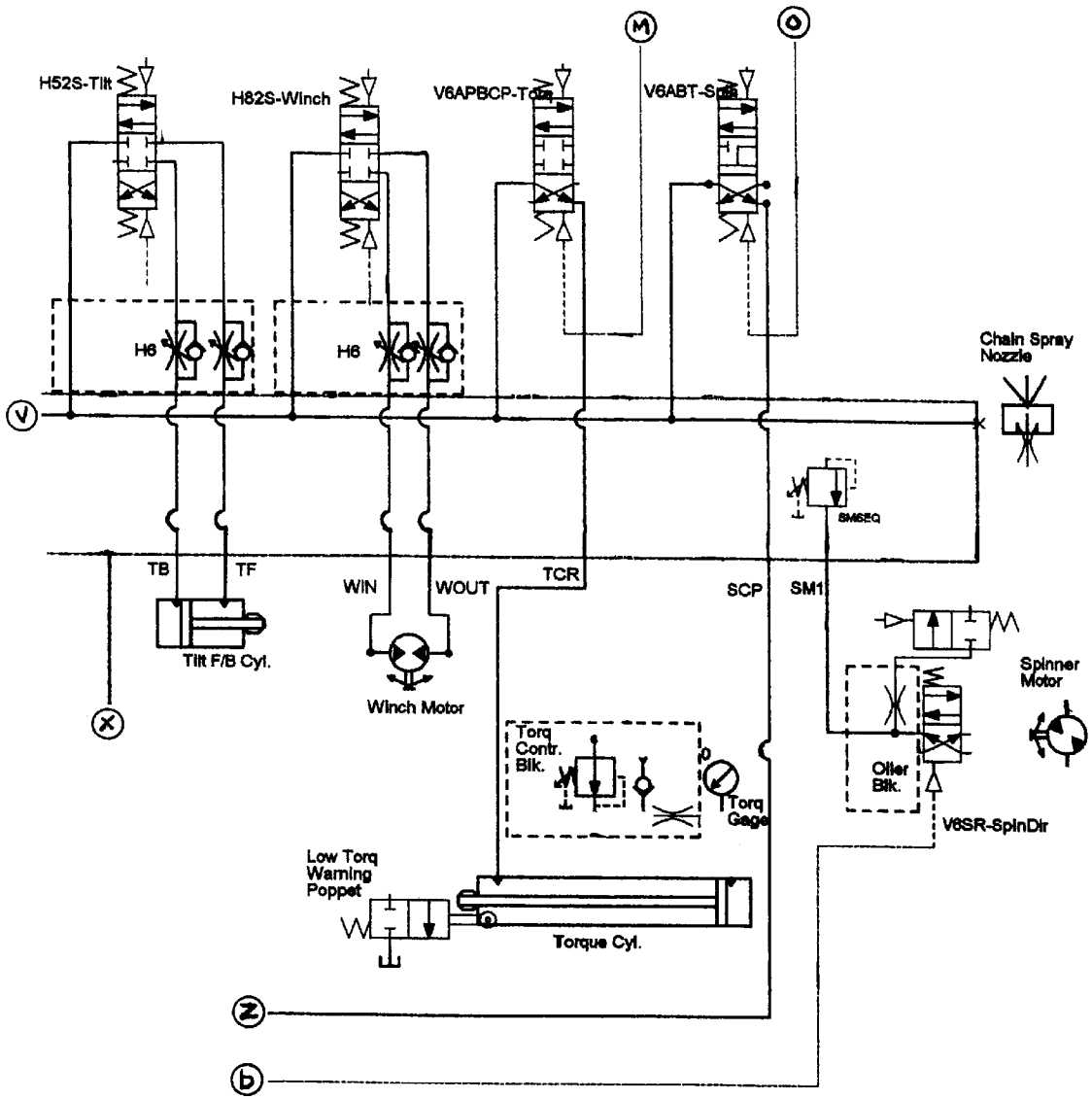
Figure 12A:
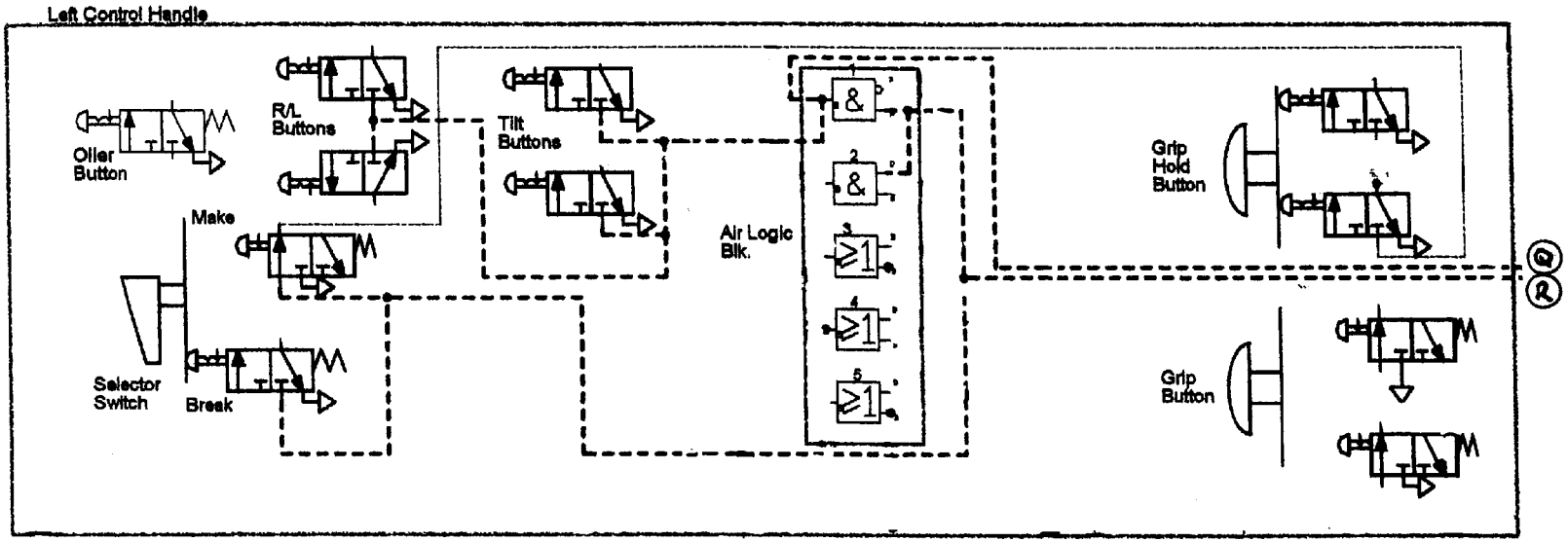
FIGS. 12*a* through 12*d* show the no-grip without grip hold features of the circuit.
Figure 12B:
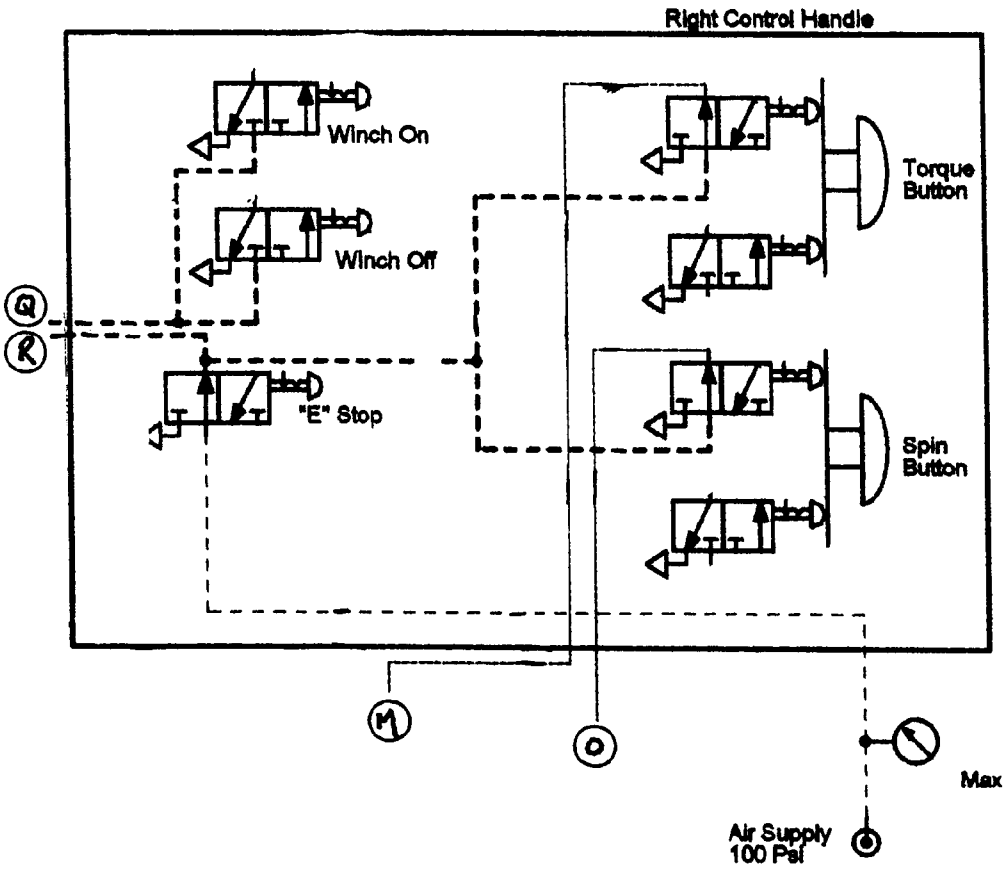
Figure 12C:
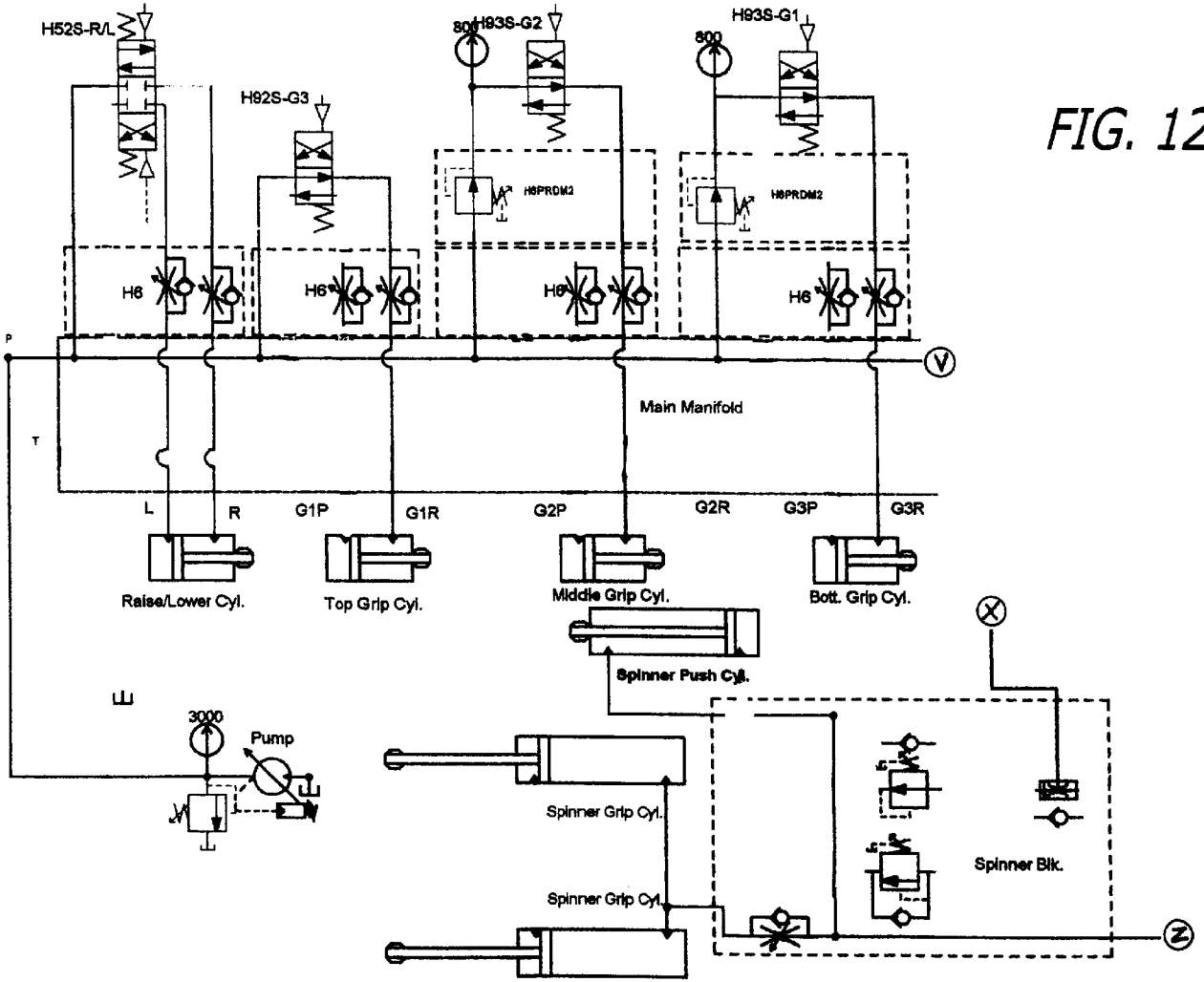
Figure 12D:
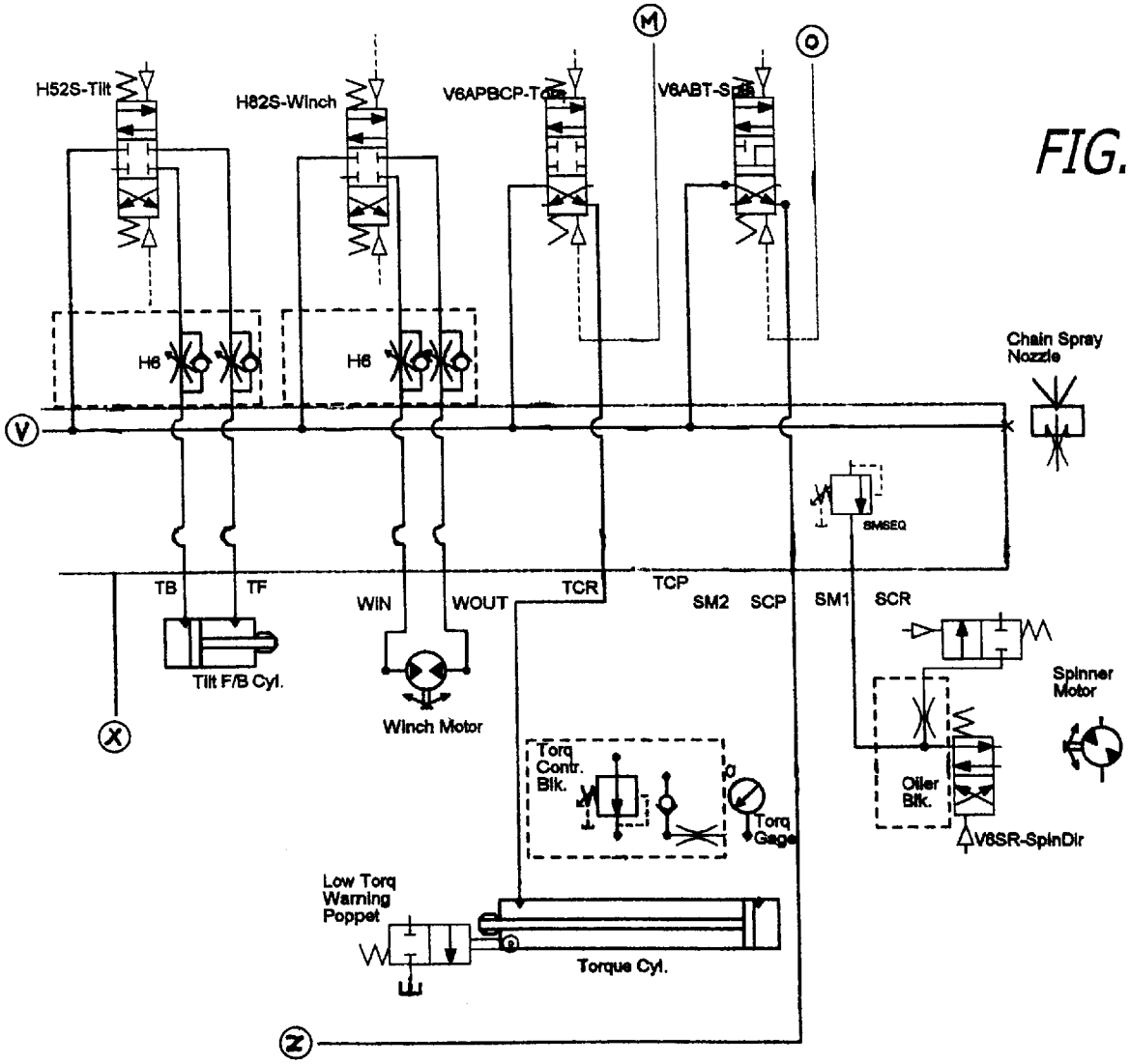

Referring to FIG. 6, the left control panel or handle 210 of the apparatus has a number of buttons including the grip hold and grip buttons 220, 230, the tilt button 232, the chain oiler button 234, the raise button 236 and the lower button 238 and the make-break selector switch 239; it also includes the air logic system. While the grip hold button 220 is a detent button, the grip button 230 is a spring button. The right control panel or handle 240, as shown in FIG. 7, has the torque button 250, the spin button 260, the E-stop button 270, the winch "on" button 280, and the winch "off" button 290, as shown in FIG. 6. Of course, other arrangements and locations for the buttons and actuators other than buttons can be used as would be apparent to those skilled in the art.

Figure 2:
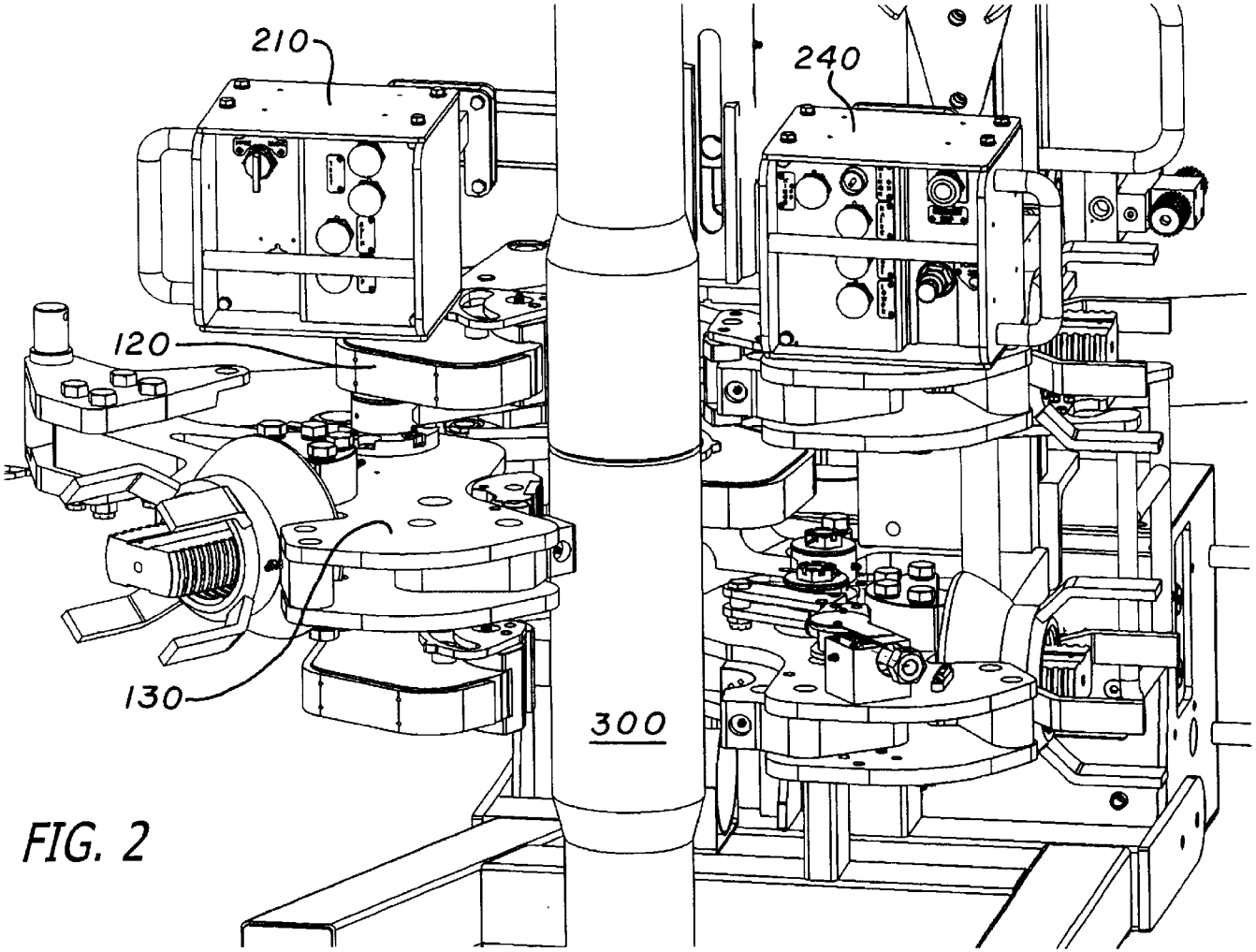
FIG. 2 is an enlarged perspective view of a lower side portion of the apparatus of FIG. 1 shown in a make-up position on a pipe.

With the apparatus 100 gripped on the pipe 300 and the middle wrench 130 in the make position (see FIG. 2) and ready to spin, the tilt cylinder 294 cannot be actuated, the winch 310 cannot be actuated and the raise and lower cylinder 320 cannot be actuated. The air valves that control the hydraulic cylinders and the motors that power these components are disabled, as will become more apparent from further explanations provided and with reference to the schematics.

When the spin button 260 is pushed, the spinner assembly 150 moves towards the pipe 300, then starts to close, and then starts to turn; that is, it moves forward, closes and then turns. A sequence valve prevents it from turning until the pressure line into the grip cylinder reaches a predetermined pressure. When the system is switched from the make/spin mode to the break/spin mode, the spinner motor 330 is caused to turn in the opposite direction.

During the making procedure, the top wrench 110 and the middle wrench 120 are gripped on the pipe 300. When the torque cylinder 340 is extended, the middle wrench 120 extends. The grip hold button 220 keeps the apparatus 100 gripped on the pipe 300 while the wrench comes back by retraction of the torque cylinder 340 and goes through as many additional torque cycles as may be needed. After a torque cycle and the grip button 230 has been released, but with the grip hold button 220 still actuated, the middle wrench 120 stays gripped. When the grip button 230 is pushed, the torque button 250 can be pushed to torque again. All the while, however, the middle wrench 120 stays gripped on the pipe, due to the actuation of the grip hold button 220. This prevents the entire apparatus 100 from coming off the pipe 300 and having to be pushed on to it and gripped again for another torque cycle (as described above for the prior art HAWKJAW apparatus).

Figure 3:
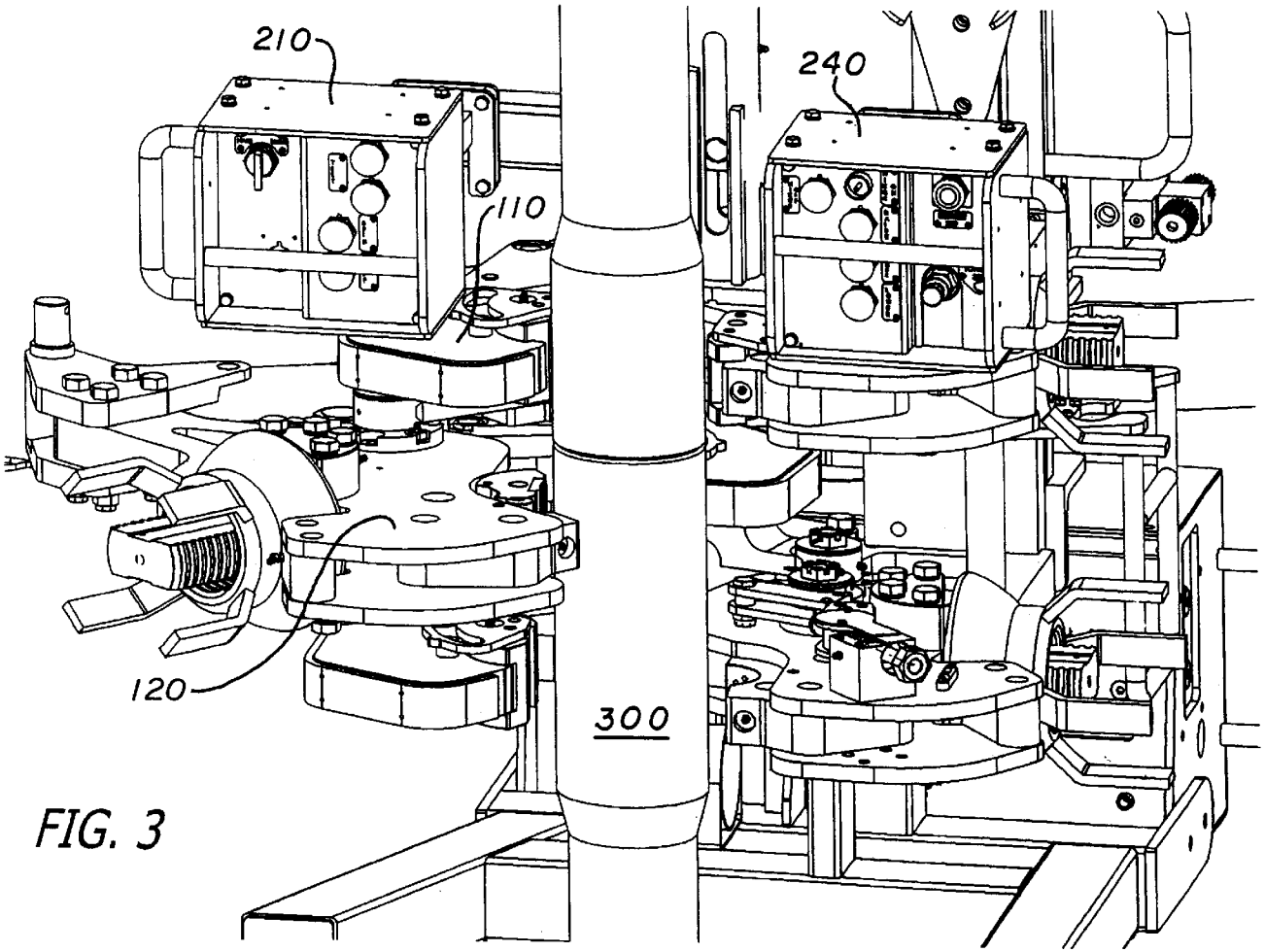
FIG. 3 is a view similar to FIG. 2 but in a break-out position.
Figure 4:
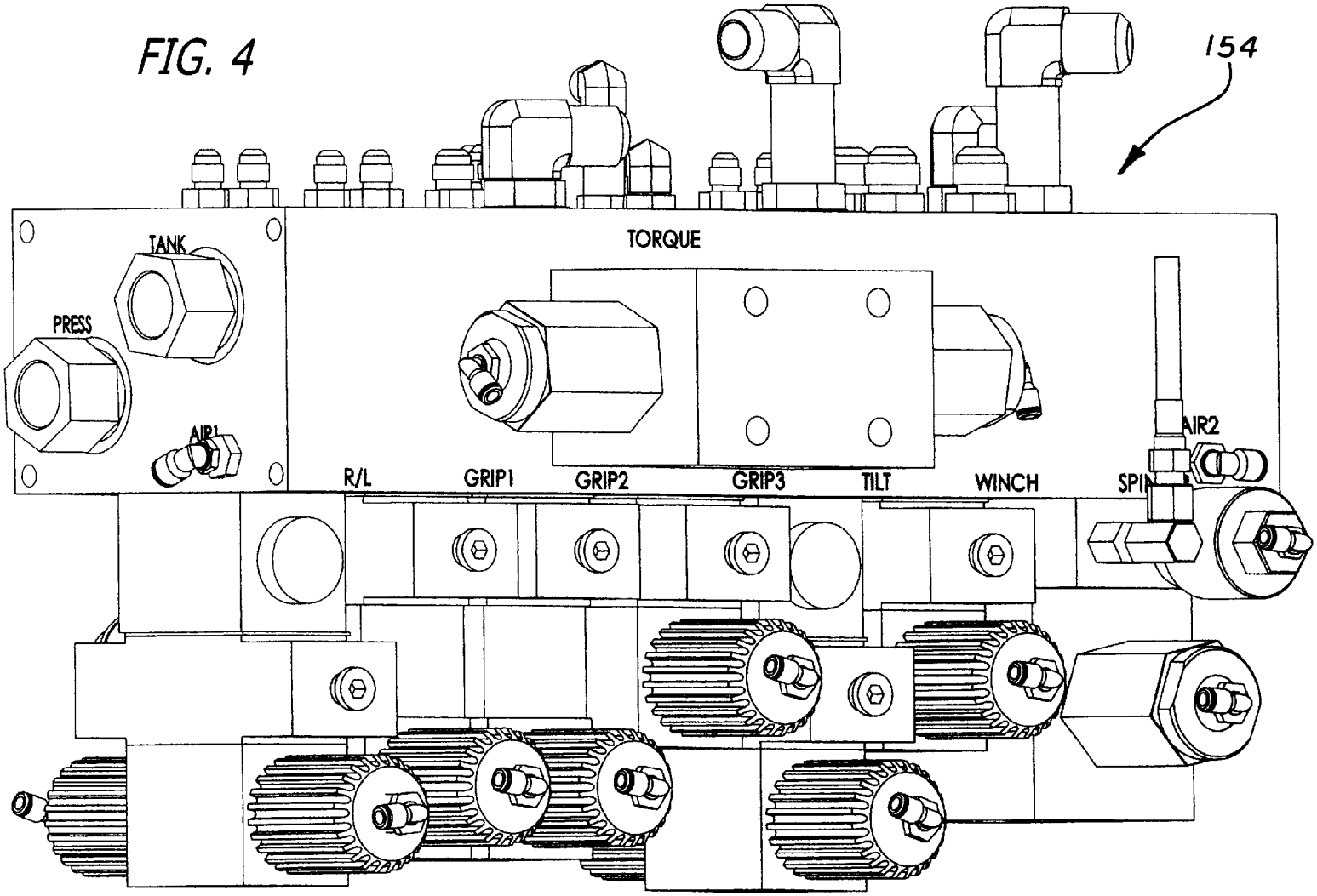
FIG. 4 is an enlarged perspective view of the hydraulic block of the apparatus of FIG. 1 illustrated in isolation.
Figure 5C:
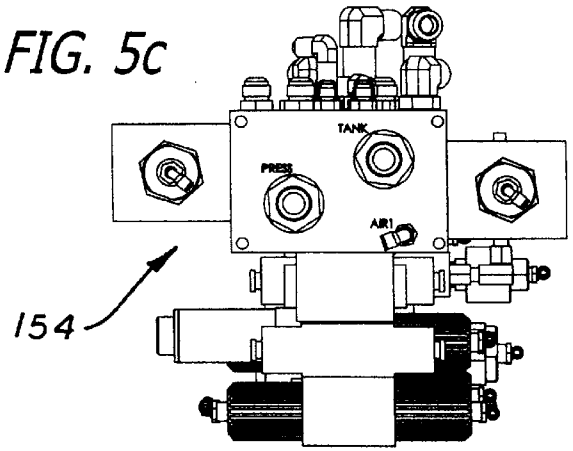
FIGS. 5*a* through 5*d* are various views of the block of FIG. 4.
Figure 5D:
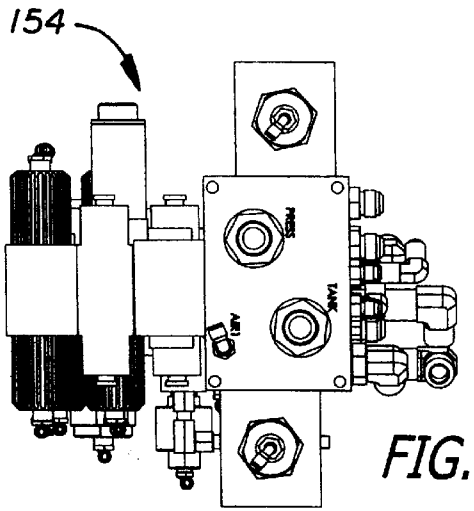
Figure 5A:
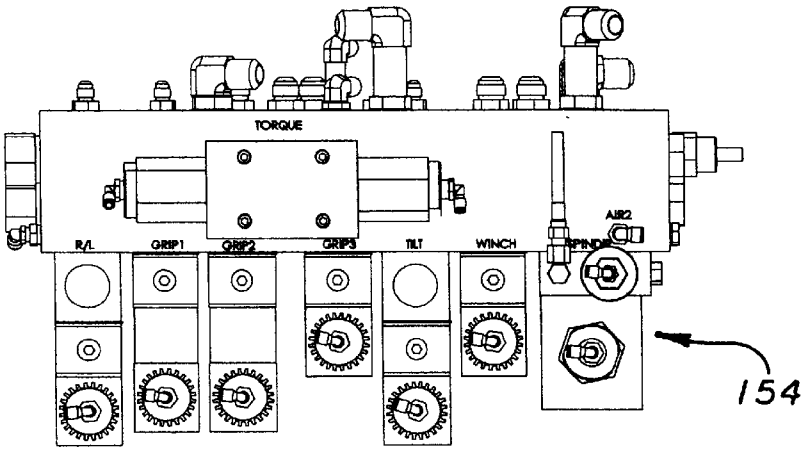
Figure 5B:
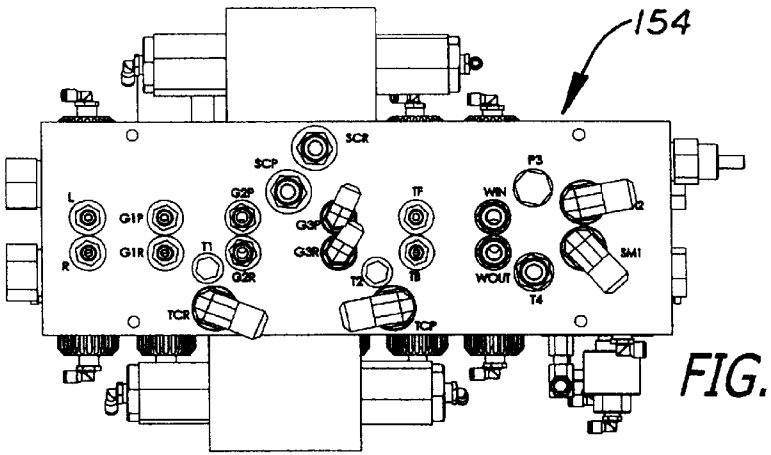

The grip hold button 220 preferably being a detent button, causes the apparatus 100 to stay gripped on the pipe 300 until the grip hold button is pressed off to de-energize the grip system. The grip hold function works on the wrench that is on the bottom of the drill pipe connection that is being made. That is, during the make operation the grip hold is the middle wrench 120, and during the break operation (see FIG. 3) it is the bottom wrench 130.

The selector switch 240 tells the system which wrench to grip and hold. Particularly, in the break mode, the bottom wrench 130, which is operated by the bottom grip cylinder 350, stays gripped; and in the make mode, the middle wrench 120 stays gripped. For each torque cycle with the grip hold button 220 already pushed (actuated), the grip button 230 is pressed and then the torque button 250. The logic system provides that if torquing is desired and the grip button 230 is not pushed and the grip hold button 220 is pushed, the torque cylinder 340 will not extend. It will not torque the pipe 300 until both wrenches are gripped on the pipe.

For the spin/make mode, the grip hold button 220 is pushed to grip the middle wrench 120 on the pipe, and the middle grip cylinder extends. In the break mode, the bottom wrench 130 is gripping the pipe 300, on the bottom connection of the drill pipe, and the spinner button 260 is pushed, the motor 354 rotates in the opposite direction as for the spin/make. The push cylinder 360 is pushed all the way forward to push the spinner assembly 150 on the pipe and the grip cylinders 364, 368 gripping the spinner on the pipe 300 are retracted.

FIGS. 11*a*–11*d* show the grip-hold disables, raise and lower, tilt and winch condition of the circuit. As previously stated, the grip button 230 cannot be pushed without the grip hold button 220 being on. In a make or break condition, the grip hold button 220 can be pushed, and the apparatus 100 will clamp on the pipe. However, in this grip hold condition, the raise and lower, tilt and winch features are disabled; all of the control buttons to them are disabled. There is no air to move their corresponding valves to their active positions so that their motors or cylinders can be activated. Also, the grip hold button 220 will not activate without the system being in either the make or break modes, as determined by the selector switch 240.

Figure 16:
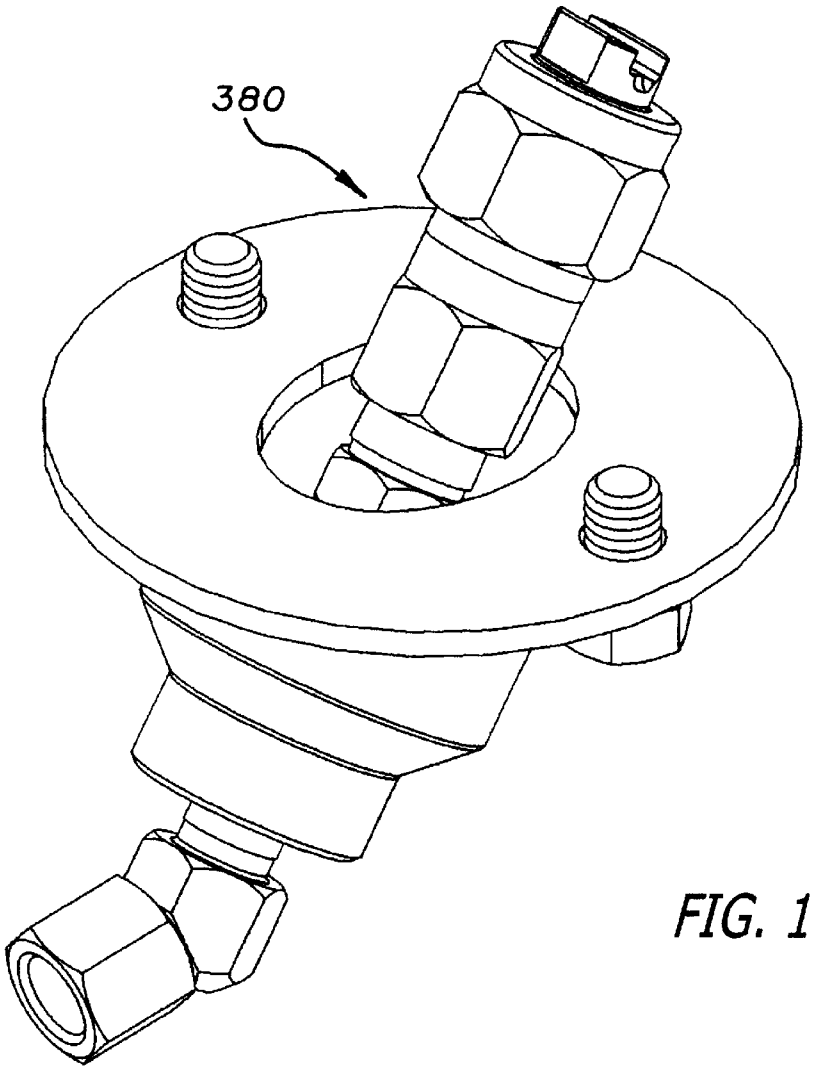
FIG. 16 is an enlarged view of the spray nozzle of the spinner of FIG. 14 shown in isolation.

Referring to FIGS. 9*a*–9*d*, the chain oiler system cannot operate unless the spinner is rotating (the spinner motor 370 is running). That is, the only time oil gets to the chain's spray nozzle 380 (see FIG. 16) is when the spinner motor 370 is rotating, and this is because pressure only arms the spray nozzle valve 374 when the spinner motor is running. With the oiler button 234 pushed and the motor 370 spinning, oil can flow through the valve 390 and into the nozzle 380 to spray on the chains 400. That is, the chains 400 can only be sprayed when the spinner motor 370 is running or pressurized and the chain oiler button 234 has been pushed. It only sprays when the spinner motor 370 is running, and the spinner motor 370 will only run for two or three seconds because that is all that is required for the spinning operation. When the spinner button 260 is released the oiler button 234 is also de-energized. In other words, even if the user holds the oiler button 234 in its on position, no oil will be sprayed.

FIGS. 10*a*–10*d* show the no torque, without grip and grip hold condition of the circuit of the apparatus 100 of FIG. 1. The system is in the make or break position, the grip button 230 is not pushed but the grip hold button 220 is pushed. When the torque button 250 is pushed nothing happens to the torque cylinder 400. The torque cylinder 400 will not extend unless both the grip and grip hold buttons 230, 220 are pushed. The grip button 230 is designed so that it cannot be pushed without the grip hold button 220 pushed because there is no reason to use the grip button 230 without the grip hold button 220 pushed. When the grip hold button 220 is deactivated, the grip button 230 is disabled. In other words, the apparatus 100 cannot be torqued on the pipe unless the grip and grip hold buttons 230, 220 are pushed.

With the grip hold and the grip buttons 220, 230 pushed, the torque button 250 can be pushed to cause the torque cylinder 410 to extend. Typically, only one extension is needed to make up most drill pipe, although some traditional drill pipes require more than one extension. However, on the tapered connection like the previously-discussed HYDRIL wedge thread pipe, a number of extensions of the torque cylinder are normally required to torque the pipe up. That is a primary reason why the grip hold button 220 and function are provided herein. Thus, in the standard make torque function, the selector switch 240 is in the make position, the grip hold button 220 is pushed and the grip button 230 is pushed, the torque button 250 can then be pushed to extend the torque cylinder 410.

Accordingly, for the present invention, for the make operation, the apparatus 100 is pulled onto the pipe 300, the top and middle wrenches 110, 120 are located correctly above and below the connections, the connection is spun and then torqued. The present invention provides for a grip hold button 220 (or other type of actuator) and when pushed or actuated, when in the make position, causes the middle wrench 120 to maintain the grip on the bottom pipe connection.

With the make/break selector switch 239 in the "make" position and the grip button 230 pushed, the spin button 260 is pushed to spin the connection together. The spinning, as known by those skilled in the art, sometimes does not shoulder the connection entirely, especially with the HYDRIL type (tapered threads) pipes or even with the standard type pipes, but rather there is a small one-quarter (or smaller) inch separation space. The torque button 250 is pushed to begin the torque cycle wherein the top wrench is gripped and the torque cylinder 410 extended. When the torque cylinder 410 has been extended and another torque cycle is needed, the apparatus 100 is not released from the pipe 300 requiring that it be pushed back and reset on the drill string pipe. Rather, the detented grip hold button 220 has been pushed so that the middle wrench remains gripped on the pipe.

For the break operation, the selector switch 239, which is preferably but not necessarily on the left control 210 as shown in FIG. 5, is switched to the break position. By pressing the raise button 236 the apparatus 100 is raised so the middle wrench 120 is on the top pipe section and the bottom wrench 130 is on the bottom pipe section. When the grip hold button 220 is pushed, the bottom wrench 130 grips on the bottom connection. The system knows to grip the bottom wrench 130 when the selector switch 239 is in the break position because of the system's air logic system or other type of control system. The grip button 230 is pushed so that the middle wrench 120 grips on the pipe. Pressing the torque button 250 causes the torque wrench to extend. A number of torque cycles may be needed to break the connection. After torquing, the spin button 260 is pressed so that the spinner can complete the unthreading of the top pipe from the lower pipe.

The grip hold button 220 allows the system to stay on the pipe as it goes through its torquing cycles. When the grip hold button 220 is pushed, the tilt button 232 will not work nor will the raise and lower buttons 236, 238. The winch 430 on the back of the unit 100 that hooks to the derrick and which allows the unit to come on the pipe and to be pulled away will also not work. In other words, the apparatus is thereby protected against being pulled off of the pipe 200 when the middle wrench 120 is gripped. The middle wrench 120 is basically a floating wrench, and is spring loaded into its default position. If the middle wrench 120 were gripped and the apparatus 100 were pulled away from the pipe 200, the middle wrench 120 would be pulled away from the (HAWKJAW) apparatus and this would damage the system.

Thus, the grip hold system provides safety overrides. They make sure that the apparatus 100 cannot be pulled off the pipe 200 while the grip hold button 220 is actuated. Particularly, the tilt, raise and lower and winch on or winch off functions will not operate when the grip hold is gripped.

The earlier-described prior art HAWKJAW apparatus, over which the inventions disclosed herein are extensions and improvements, only had a grip button. Pursuant to one aspect of the present invention, the apparatus has a grip button 230 and a grip hold button 220. The reason for having these two buttons is because the grip hold works to allow the middle or bottom wrench gripped on the pipe 200 independent of the other wrenches that do the torquing. The grip hold button 220 causes the bottom wrench 120 to grip; the bottom wrench does not rotate and defines a stationary connection. The grip button 230 grips the wrench that does the rotating. If the grip hold button 220 is de-energized, the grip button 230 is made inoperative. However, the operator can raise or lower the machine 100, actuate the winch, or tilt the apparatus. The spinner motor cannot be operated because it has to be gripped on the pipe to spin. When the grip hold button 220 is pushed the spin button 260 can be pushed and the spinner actuated.

With the grip hold and the grip buttons 220, 230 pushed and the system in the break position, the E-stop button 270 (on the right control panel 240 as depicted in FIG. 6) can be pressed in an emergency. When it is pressed, the torque cylinder 410 stops in mid-stroke. The torque cylinder does not move because the torque valve 440 is shifted to its middle position, with no air on either side of the valve, all ports are blocked. The torque cylinder 410 thus will not move either way because both ports to the back and front of the cylinder, the rod and piston, are blocked. Fluid is in the cylinder, but it is not moving. More particularly, when the E-stop button 270 is pressed all of the air buttons are de-energized. All the air goes out of the system, and all of the valves go to their default and/or center positions. This can be understood from the drawing schematics; four of the valves are three-position, four-way valves, and the others are two-position, four-way valves with one air signal to them. The larger valves have two air signals, one on either side. Thus, as is known in the art, this valve can be controlled and be put in three separate positions. With no air on it, like in the E-stop situation, all air is removed from the system and the valves return to their default and/or center positions.

With the E-stop button 270 pressed, the only items that are still activated are the grip cylinders 450, 460, the grip cylinders de-grip and come off of the pipe so the wrenches de-energize off the pipe. The apparatus 100 can be taken off the pipe 200, and everything is stopped so that no one can be injured. The spinner assembly 150 will tend to hold the apparatus 100 on the pipe, but the apparatus can be pulled off the pipe, since the spinner assembly will open without much effort, because both ports return to tank on its cylinder 470. Thus, it is recommended that when the apparatus is off the pipe and the apparatus is not being used that the E-stop button 270 be pushed. This de-energizes all the buttons, and the apparatus 100 cannot even be raised and lowered by using the raise and lower cylinders 480, 490. Another feature of the E-stop button 270 system is that after it has been pushed and subsequently released, it will go back to the reset mode, ready to run.

A further feature of this system is the low torque warning aspect. With the torque cylinder 410 retracted, there is a small valve hooked to the cylinder. When the piston extends to a certain point, it hits the poppet pin, and shifts the valve. This dumps the pressure in the gauge so that the needle drops to zero. The worker thus knows that the joint has not been correctly made up. In other words, when the torque piston gets all the way up and hits the poppet valve, it shifts the valve and dumps the gauge pressure causing the needle of the torque gauge 500 to drop to zero. The pipes have not been fully torqued because if the joint had been made up correctly, the torque gauge 500 will go up in torque until it reaches the preset torque and stop. It will torque to a preset torque unless the torque cylinder 410 is extended all the way out. If it has been torqued and the joint has not made up by the time the torque cylinder 410 is extended all the way and the torque cylinder hits the end of its stroke, without the low torque warning poppet, the gauge will go up and hold. Thus, the low torque warning system provides that when the torque cylinder is extended and the system is not to a fully torqued position, the needle drops to zero or close to zero to show that the desired torque has not been reached. When the cylinder 410 reaches its full extension, it hits the small valve and dumps the pressure and the gauge drops to zero.

As previously stated, when the E-stop (air) button 270 is pressed, the main air supply feeds into the E-stop valve 510, which disables all the valves. All of the air pressure is dumped and everything stops. The emergency stop button 270 is the main supplier to all the air buttons that activate all functions. Thus, when air is taken off of them, everything returns to default steady state.

A further description of an operation of the E-stop button 270 follows. Assume that the grip hold and the grip buttons 220, 230 are pushed and the system is in the break position. When the E-stop button 270 is pressed, the torque cylinder 410 stops in midstroke because the valve that works has shifted to the middle position with no air on either side of the valve. All ports are blocked in the center position. The torque cylinder 410 will not move either way because both ports to the rod and the piston are blocked. The spinner assembly is deactivated and the apparatus stays wrapped on the pipe but without any load on the system. That is, when the E-stop button 270 is pressed, all the air goes out of the system, the valves go to their center default positions. The grip cylinders 450, 460 degrip and come off the pipe 300. The spinner assembly 150 will tend to hold the apparatus 100 on the pipe 300 but the apparatus can be pulled away from the pipe causing the spinner to open. That is, pushing the apparatus 100 off of the pipe 300, fluid will be pushed back to the tank and the spinner 150 will open. Thus, when the apparatus 100 is off the pipe 300 and not being used the E-stop button 270 should be always pressed. And when it is the apparatus 100 cannot even be raised and lowered.

Unlike the old system, when the E-stop button 270 was pressed, the piston and rod went to tank meaning that the torque cylinder could extend if there was too much pressure in the tank line, that is, if it is not positively stopped. Thus, if there is too much pressure or if there is leakage in the system, the torque cylinder can extend. The new system cannot extend under such circumstances. All ports are blocked in the center position on the torque valve on the system herein, which is much safer for rig crew personnel.

In other words, when the E-stop button 270 is pushed, all ports (such as for the torque cylinder), are blocked in the center position. The rod and the piston sides are blocked so they cannot move and block the cylinders from moving. This system is particularly valuable with regards to the torque cylinder 310, because that is the cylinder that moves and can hurt a bystander when moving in an undesired manner. The present emergency system, unlike the prior system, responds very quickly. This is especially true where there was leakage in the system in the tank line which could cause the torque cylinder by itself to extend even with the prior art E-stop button pushed. If both the rod and the piston sides are connected to the same source and thus are exactly the same pressure, there is more area on the backside of the piston so it is always going to extend relative to the rod because there is more force pushing on it such as from the leakage pressure in the tank line.

Figure 15:
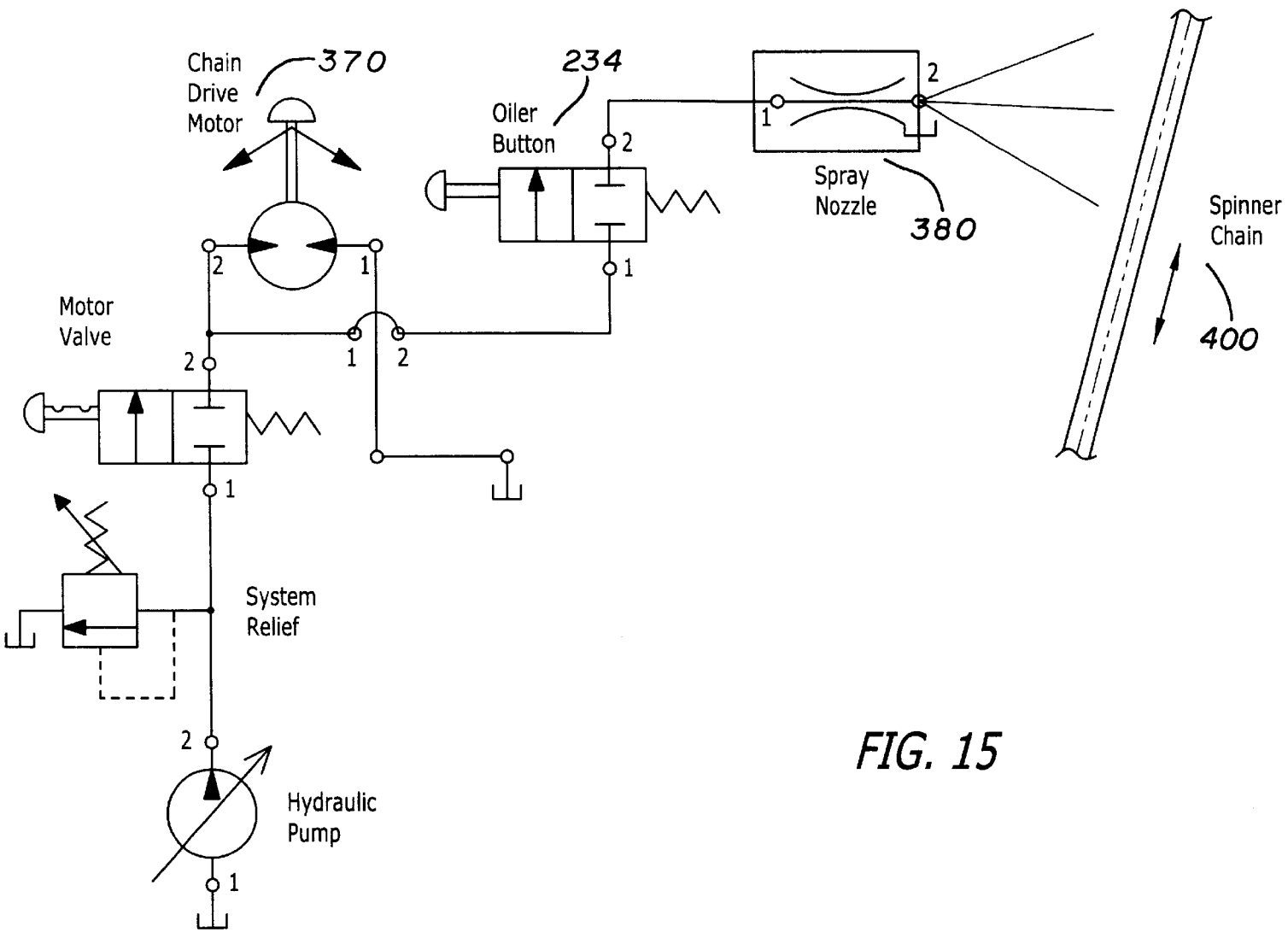
FIG. 15 is a hydraulic schematic of the spinner of FIG. 13.

The SPINMASTER spinner can be used on other pieces of equipment aside from the HAWKJAW apparatus; alternatively, it can hang on its own. When it is on its own, separate from the HAWKJAW apparatus, the controls and the system can be entirely hydraulic, without any pneumatic component. This is shown, for example, by the circuit of FIG. 15. The spinner has to be running on the pipe and turning the pipe—that is, the spinner motor 370 pressurized—before the oil will spray on the chain 400 as previously described. That is, the motor pressure must be on, so as long as there is pressure to the spinner motor, the sprayer will work with the spray button 234 pushed. If the apparatus is torqued up on the pipe and the spinner motor 370 stops and the connection is shouldered up but the motor has pressure to it, the sprayer will still spray.

Figure 13:
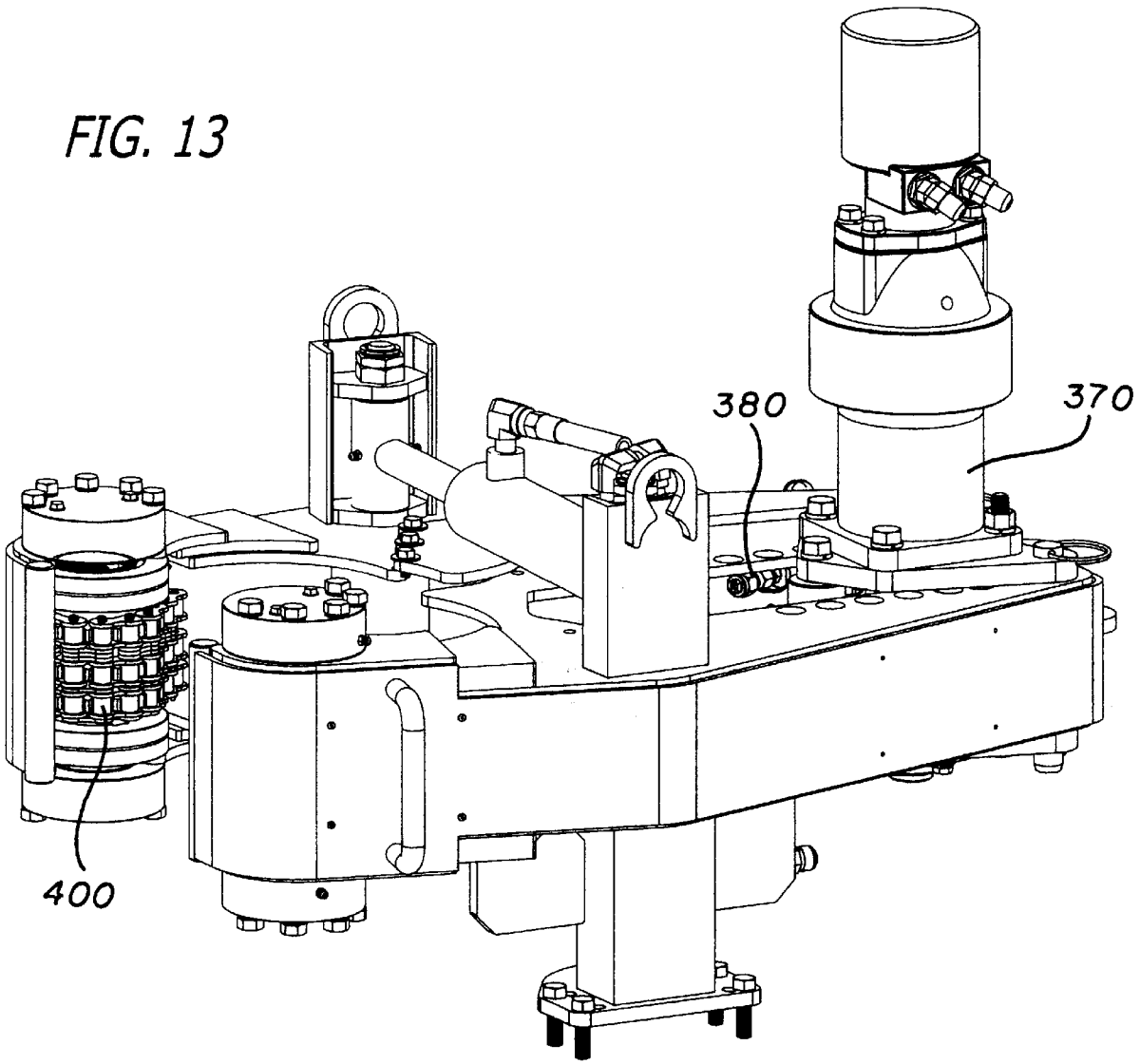
FIG. 13 is a perspective view of a chain spinner assembly of the present invention (similar to that shown at the top of FIG. 1)
Figure 14:
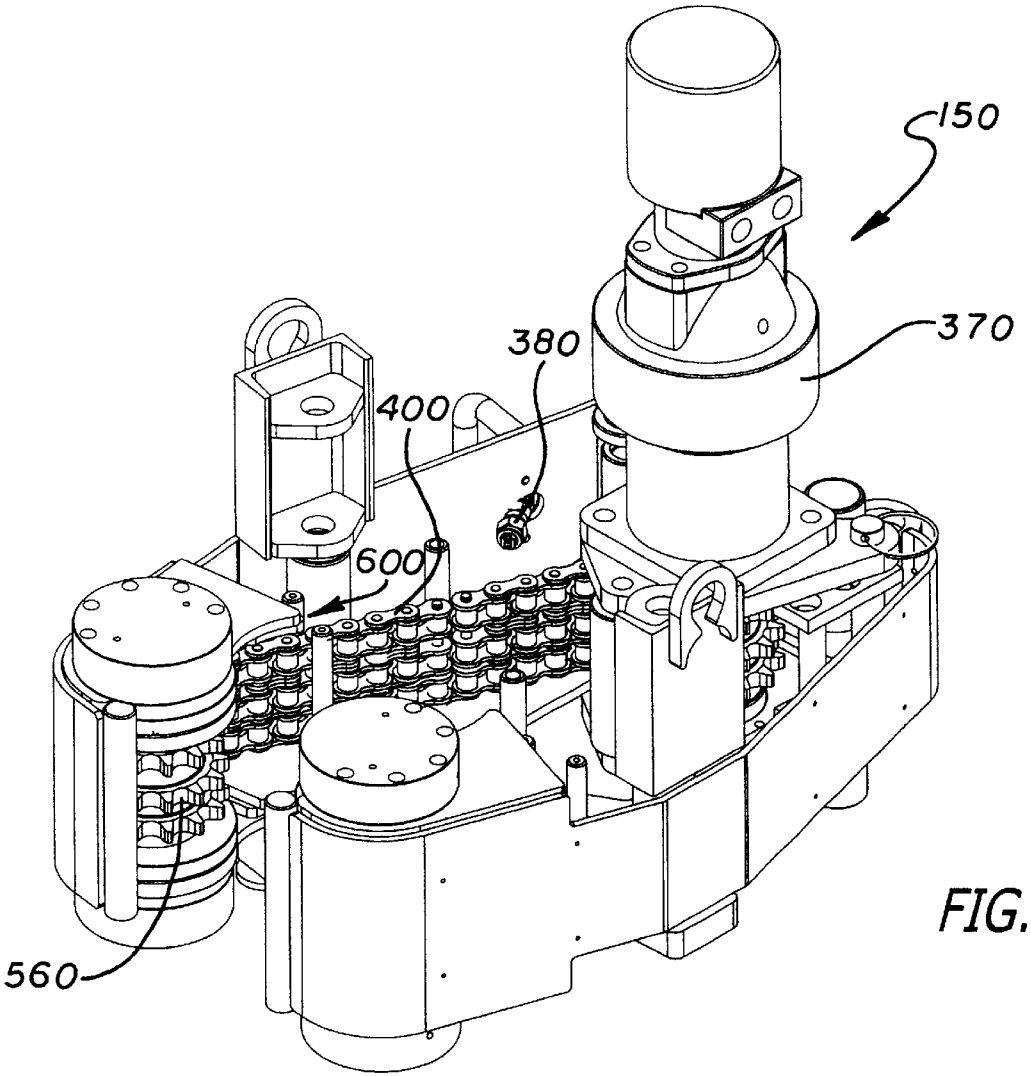
FIG. 14 is another top perspective view of the spinner of FIG. 13.

Referring to FIGS. 13*a* and 15*a* (and 14), for example, it can be seen that the nozzle 380 is proximate to the chain 400. An enlarged view of the nozzle 380 is provided in FIG. 16. The chain 400 can run in either direction, and as the chain is moving, the nozzle 380 can be spraying if the spray button is pushed. The nozzle 380 is designed and positioned to spray a pattern of oil to cover all of the links of the chain 400 as it is moving by or translating past the spray nozzle head. The sprayed oil coats the chain 400 and seeps into the chain pins and links, thereby efficiently lubricating them.

The present onboard spraying system allows the chain 400 to be lubricated, for example, on a daily basis before the operator starts to spin the pipe and also to be lubricated at the end of the day before shutdown. It is anticipated that this effective user-friendly lubrication system will double or triple the chain life. Additionally, it maintains spinner power; this is because when a chain starts corroding, the power of the spinner to torque the pipe is reduced.

The oiler only works when the spinner motor 370 is pressurized, as previously stated. Specifically, the oiler valve will not shift and allow oil to come up into the spray nozzle 380 and spray on the chain unless the motor is pressurized. The fluid flows out of the hydraulic system—out the spray nozzle 380 onto the chain as the motor is turning. It is powered by fluid going through the spinner motor 370. The nozzle is spraying the hydraulic fluid which comes from the power unit tank (which has about one hundred gallons capacity). It only sprays for about a second and a half and applies one-twentieth of a gallon for each spray. The user may spray once a day or once a week, for example.

Thus, as long as the spinner motor 370 is pressurized, oil can be sprayed. When the chain oiler button 234 is pushed, lubricating oil is sprayed on the spinner chain 400, with the pressure for spraying the oil provided by the running motor. In other words, when the motor is not running the oil cannot be sprayed. This makes for an efficient oil spraying because the chain 400 is then moving during the spraying operation and the oil can be evenly deposited over the entire length of the chain.

The present oiler system is advantageous because oil is not sprayed on a nonmoving chain. The oiler button 234 is only effective when the chain is moving so that the spray can cover the entire chain 400 with a coating of oil as it is operating. If the chain 400 is not moving while the oil is bring sprayed on it, the oil will just drip down and ineffectively/inefficiently lubricate and will tend to exhaust the oil supply. Thus, the button 234 is only enabled when the spinner is operating on a pipe. The fluid that is sprayed is the hydraulic fluid of the HAWKJAW apparatus, the SPINMASTER apparatus, the power unit of the HAWKJAW apparatus or the rig unit.

The chain oiling system can be incorporated on the hydraulic block 145. It has a manifold with a triggering valve that takes oil from the spinner valve only when the spinner is running. When the motor is rotating and the spinner chain 400 is thereby moving, the oil is sprayed using spinner motor oil pressure. When the spinner motor 370 is not seeing oil, it does not have the pressure on it and it is not rotating the chain, and there is thus no pressure on the oiling system. The button 230 can be pressed but there is no pressure available to spray on the chain because the motor is not running. In other words, the motor pressure forced in the fluid is used to spray the oil on the chain. The spray will be approximately a forty-five degree (or larger) angle spray, and can be adjusted to effectively coat the chain.

An air-piloted hydraulic two-way valve is screwed into the manifold underneath the spinner valve assembly that operates the motor. It only takes the fluid that is under pressure, only when the spinner motor is activated, and dispenses it to a hose 530 that runs to the spray head nozzle of the spinner. As stated above, the spinner chain must be moving before the oiler button will work.

The chain 400 is a continuous chain driven by a hydraulic motor 370. Referring to the drawings, looking down on the spinner, if it is moving in a clockwise direction, it is spinning the pipe out; and if it is moving in the opposite direction, it is spinning it in. The SPINMASTER spinner has a manual adjustment procedure for adjusting it so that the chain runs at a different effective length to accommodate different sizes of pipe. A plurality of holes 560 are provided defining different positions for the unit, and pins are then inserted through the unit into the desired holes to position it in the desired position. The pins can be pulled out and the unit pulled back to the most rearward holes so that the chain size can handle pipes from 3½ to 9½ inches. If this prior art spinner were run without a pipe in it, the chain would tend to get piled up on the slack side. The sprockets 560, 570 at the ends of the pivotally mounted casing arms 580, 590 would grab the slack chain, and the torque of the spinner would pull the chain through into the side panel and rip the side panel out. The chain would bind up and tear the unit apart.

Figure 17:
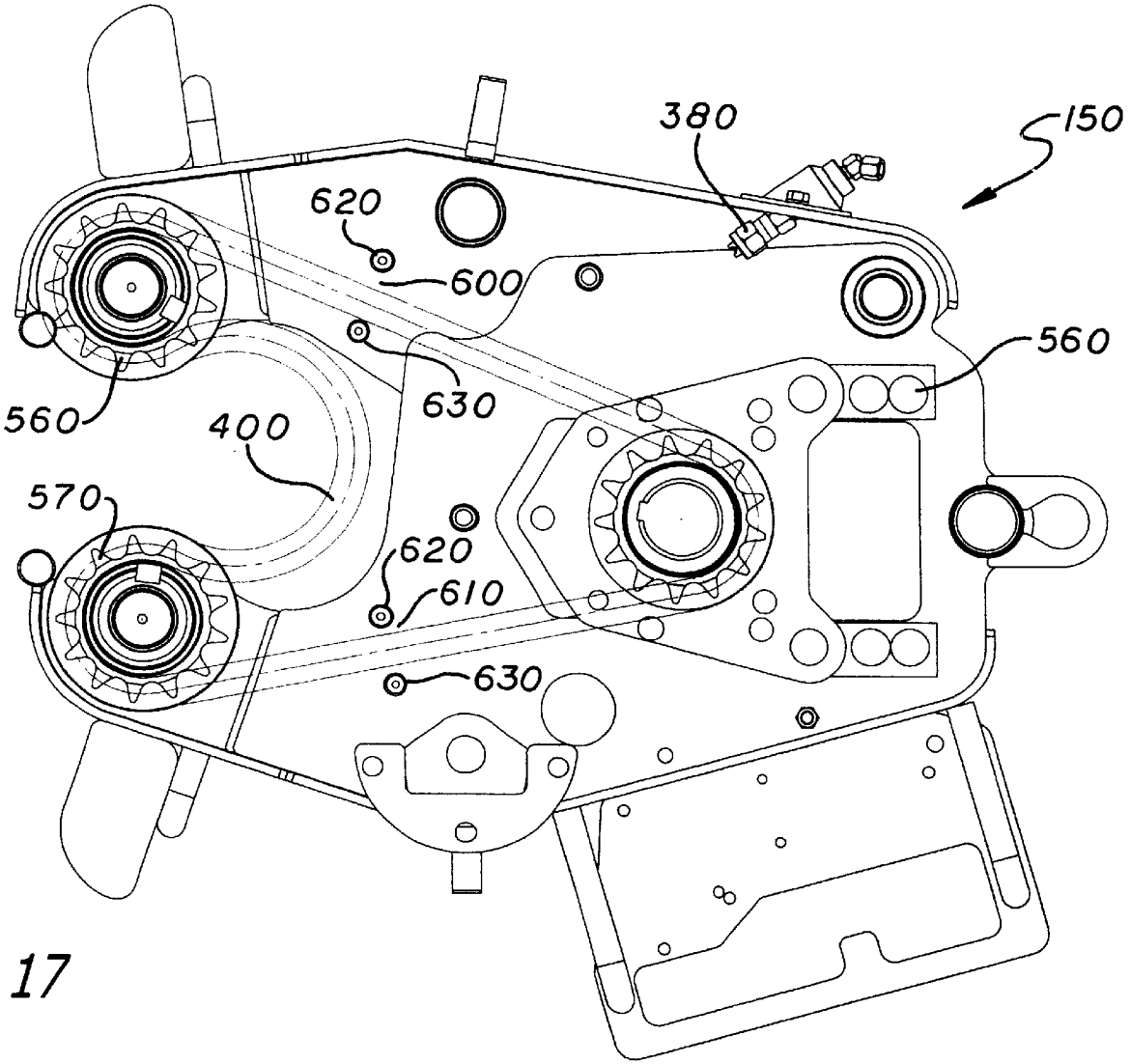
FIG. 17 is a top plan view of the spinner of FIG. 14 in an increased effective chain length position for larger pipe.
Figure 18:
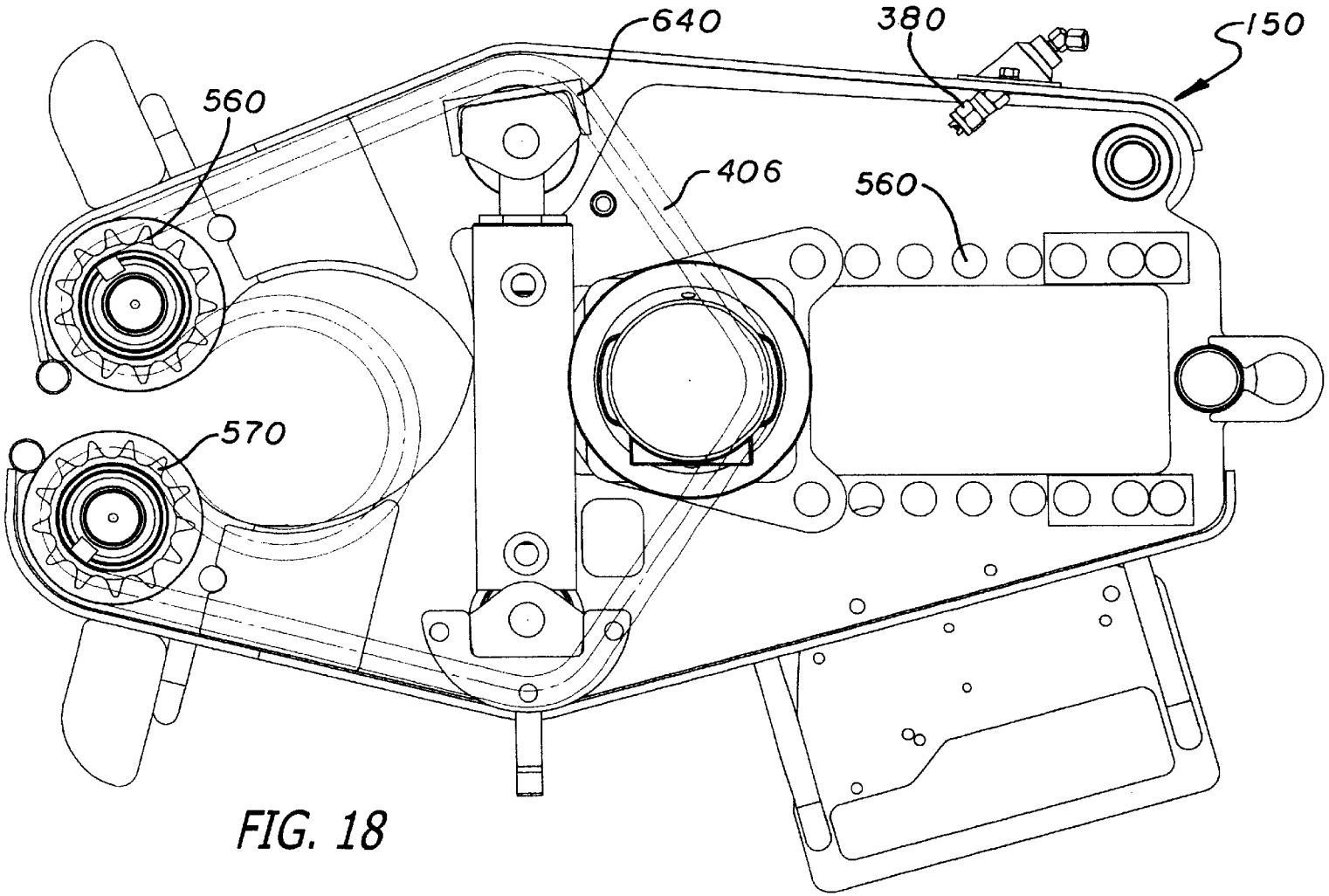
FIG. 18 is a view similar to FIG. 17, illustrating a larger embodiment of the spinner of FIG. 17.
Figure 19:
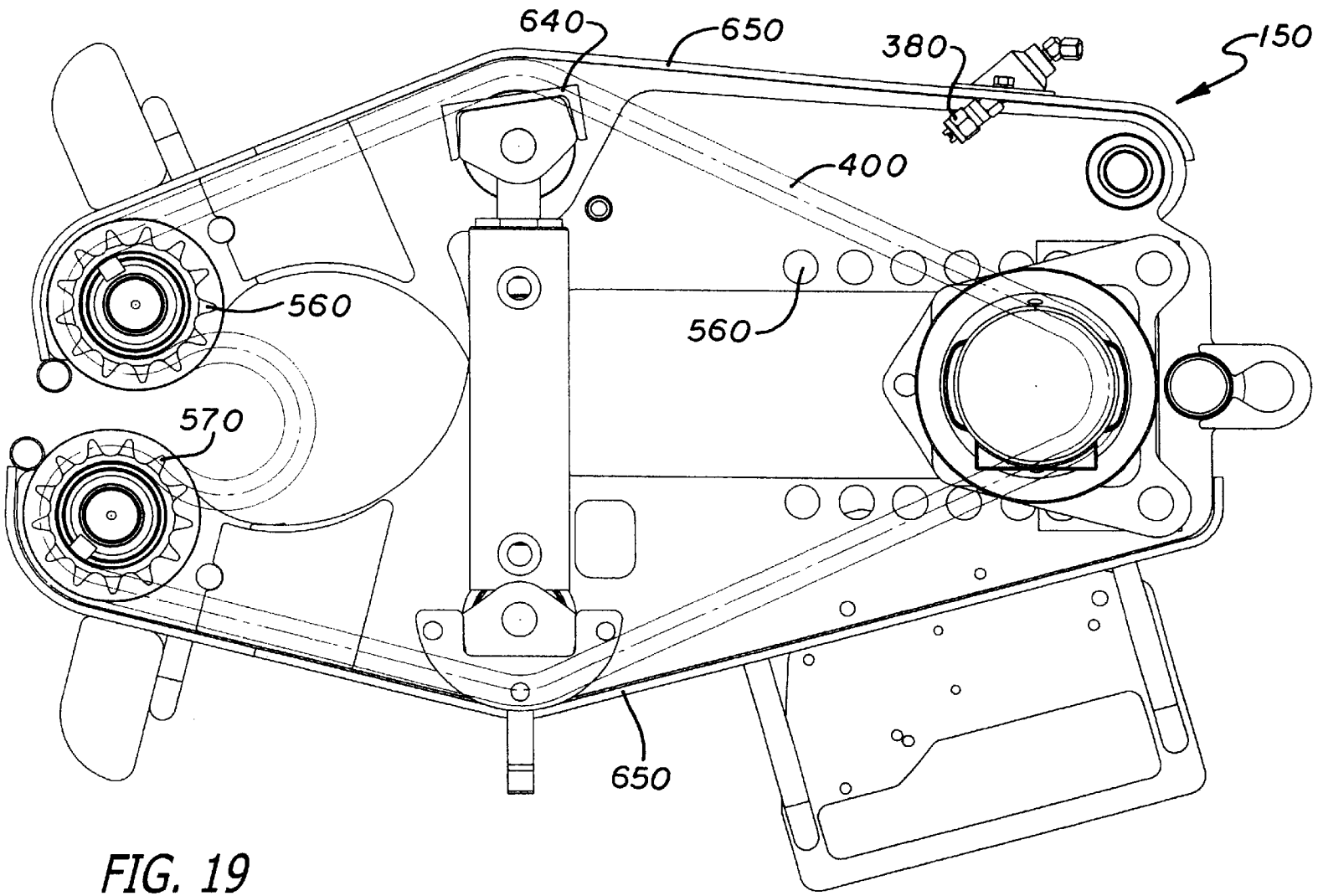
FIG. 19 is a view similar to FIG. 18, illustrating the spinner in a reduced effective chain-length condition for smaller pipe.

To solve this problem, one or more guide "windows" 600, 610 are constructed on the unit pursuant to the present invention. The windows 600, 610 prevent the chain 400 from getting bound up and twisted. Thus, it does not get grabbed by the sprockets 560, 570 and tend to rip the side panel off. The windows 600, 610 can be formed by a pair of spaced posts 620, 630, such as shown in FIG. 17 for the smaller version that holds pipe up to 5½ inch diameter, or by a post structure 640 and a housing side wall 650, such as shown in FIGS. 18 and 19, for the larger version that runs up to 9½ inch diameter pipe.

With the windows 600, 610 provided and the spinner motor 540 turned on and without any pipe being run, the chain 400 will freewheel through the windows and not bind and get caught up in the sprockets. It is a type of tracking mechanism to make sure the chain 400 stays in the appropriate position and condition before it reaches the sprockets. The windows 600, 610 thereby keep the chain from getting tangled up.

From the foregoing detailed description, it will be evident that there are a number of changes, adaptations and modifications of the present invention that come within the province of those skilled in the art. The scope of the invention includes any combination of the elements from the different species, embodiments, functions and/or subassemblies disclosed herein, as would be within the skill of the art. However, it is intended that all such variations not departing from the spirit of the inventions be considered as within the scope thereof.

What is claimed is:

1. A pipe make/break apparatus, comprising:

top, middle and bottom wrenches;

with the apparatus in a break position, the middle and bottom wrenches are operatively positioned on opposite sides of a pipe joint of a drill pipe;

with the apparatus in a make position, the top and middle wrenches are operatively positioned on opposite sides of a pipe joint; and a grip-hold actuator which when actuated and with the apparatus in the make position causes at least one of the middle and top wrenches to be held on the drill pipe between wrench torquing cycles during a make operation; and the actuator when deactuated at an end of the make operation causes the at least one of the middle and top wrenches to be released from the drill pipe.

2. The apparatus of claim 1 wherein the actuator comprises a detented grip hold button.

3. The apparatus of claim 1 further comprising a grip actuator which when actuated causes the other one of the middle and top wrenches to be gripped on the drill pipe during a make operation.

4. The apparatus of claim 1 further comprising a grip hold actuator which when actuated causes at least one of the middle and bottom wrenches to be held on the drill pipe between wrench torquing cycles during the break operation.

5. A pipe spinner assembly, comprising:

a chain for engaging a pipe section and rotating it in making or breaking operations;

a spinner motor for operatively running the chain on the pipe section; and a nozzle for spraying by pressure from the spinner motor, when the spinner motor is running, lubricating oil on the running chain.

6. The assembly of claim 5 further comprising an operator-controlled actuator operatively associated with the nozzle for actuating same.

7. The assembly of claim 6 wherein the actuator includes a push button.

8. A pipe spinner chain lubricating method, comprising:

using a motor, running a pipe spinning chain; and using pressure from the running motor, spraying lubricating oil on the running chain.

9. The lubricating method of claim 8 wherein the spraying is out a nozzle operatively mounted relative to the chain.

10. The lubricating method of claim 9 further comprising operating an actuator to control the spraying.

11. The lubricating method of claim 10 wherein the actuator includes a push button.

12. The lubricating method of claim 8 further comprising guiding the chain away from chain sprockets.

13. The lubricating method of claim 12 wherein the guiding includes passing the chain through at least one window.

14. The lubricating method of claim 13 wherein the at least one window includes a window defined by a pair of spaced posts.

15. The lubricating method of claim 12 wherein the guiding includes passing the chain on the outside of a guide post.

16. The lubricating method of claim 15 wherein the guide post is mounted to a floor of a casing and a chain guide window through which the chain passes is defined on one side by the guide post and on the other side by a wall of the casing.

17. A pipe make or break apparatus, comprising:

a frame;

a first wrench connected to the frame;

a second wrench connected to the frame;

a torquing cylinder operatively connected between the first or second wrench and the frame;

a grip hold actuator which when in an actuation condition causes the second wrench to grip onto a pipe below a pipe joint;

a grip actuator which when actuated causes the first wrench to grip onto the pipe above the pipe joint;

the grip actuator can be actuated only when the grip hold actuator is in the actuation condition;

a torque actuator which when actuated actuates the torquing cylinder; and the torque actuator can be actuated only when the grip actuator is actuated;

wherein the grip hold actuator includes a detent grip hold button.

18. The apparatus of claim 17 further comprising a first control panel supported by the frame; a second control panel supported by the frame; and the detent grip hold button is on the first control panel.

19. The apparatus of claim 18 wherein the grip actuator includes a spring-loaded button on the first control panel.

20. The apparatus of claim 17 wherein the grip actuator includes a spring-loaded button.

21. The apparatus of claim 17 further comprising a raise/lower actuator which when operatively actuated causes the frame to raise or lower relative to the drill pipe, and the raise/lower actuator can be operatively actuated only when the grip hold actuator is not in the actuation condition.

22. The apparatus of claim 17 further comprising a tilt actuator which when operatively actuated causes the frame to tilt relative to the drill pipe, and the tilt actuator can be operatively actuated only when the grip hold actuator is not in the actuation condition.

23. The apparatus of claim 17 further comprising a spin actuator which when actuated causes a spinner to spin an upper pipe section relative to a lower pipe section, and the spin actuator can be operatively actuated only when the grip hold actuator is actuated.

24. The apparatus of claim 17 further comprising a third wrench connected to the frame.

25. The apparatus of claim 24 wherein the third wrench is above the first and second wrenches.

26. The apparatus of claim 24 wherein the third wrench is below the first and second wrenches.

27. The apparatus of claim 17 wherein the torquing cylinder is operatively connected to the first wrench.

28. The apparatus of claim 17 wherein the torquing cylinder is operatively connected to the second wrench.

29. A pipe make or break apparatus, comprising:

a frame;

a first wrench connected to the frame;

a second wrench connected to the frame;

a torquing cylinder operatively connected between the first or second wrench and the frame;

a grip hold actuator which when in an actuation condition causes the second wrench to grip onto a pipe below a pipe joint;

a grip actuator which when actuated causes the first wrench to grip onto the pipe above the pipe joint;

the grip actuator can be actuated only when the grip hold actuator is in the actuation condition;

a torque actuator which when actuated actuates the torquing cylinder;

the torque actuator can be actuated only when the grip actuator is actuated; and a tilt actuator which when operatively actuated causes the frame to tilt relative to the drill pipe, and the tilt actuator can be operatively actuated only when the grip hold actuator is not in the actuation condition.

30. The apparatus of claim 29 wherein the torquing cylinder is operatively connected to the first wrench.

31. The apparatus of claim 29 wherein the torquing cylinder is operatively connected to the second wrench.

32. The apparatus of claim 29 wherein the grip hold actuator includes a grip hold button.

33. The apparatus of claim 29 wherein the grip actuator includes a spring-loaded button.

34. The apparatus of claim 29 further comprising a raise/lower actuator which when operatively actuated causes the frame to raise or lower relative to the drill pipe, and the raise/lower actuator can be operatively actuated only when the grip hold actuator is not in the actuation condition.

35. The apparatus of claim 29 further comprising a spin actuator which when actuated causes a spinner to spin an upper pipe section relative to a lower pipe section, and the spin actuator can be operatively actuated only when the grip hold actuator is actuated.

36. The apparatus of claim 29 further comprising a third wrench connected to the frame.

37. A pipe make or break apparatus, comprising:

a frame;

a first wrench connected to the frame;

a second wrench connected to the frame;

a torquing cylinder operatively connected between the first or second wrench and the frame;

a grip hold actuator which when in an actuation condition causes the second wrench to grip onto a pipe below a pipe joint;

a grip actuator which when actuated causes the first wrench to grip onto the pipe above the pipe joint;

the grip actuator can be actuated only when the grip hold actuator is in the actuation condition;

a torque actuator which when actuated actuates the torquing cylinder;

the torque actuator can be actuated only when the grip actuator is actuated; and a third wrench connected to the frame.

38. The apparatus of claim 37 wherein the third wrench is above the first and second wrenches.

39. The apparatus of claim 37 wherein the third wrench is below the first and second wrenches.

40. The apparatus of claim 37 wherein the torquing cylinder is operatively connected to the first wrench.

41. The apparatus of claim 37 wherein the torquing cylinder is operatively connected to the second wrench.

42. The apparatus of claim 37 wherein the grip hold actuator includes a grip hold button.

43. The apparatus of claim 42 further comprising a first control panel supported by the frame; a second control panel supported by the frame; and the grip hold button is on the first control panel.

44. The apparatus of claim 43 wherein the grip actuator includes a spring-loaded button on the first control panel.

45. The apparatus of claim 37 wherein the grip actuator includes a spring-loaded button.

46. The apparatus of claim 37 further comprising a raise/lower actuator which when operatively actuated causes the frame to raise or lower relative to the drill pipe, and the raise/lower actuator can be operatively actuated only when the grip hold actuator is not in the actuation condition.

47. The apparatus of claim 37 further comprising a tilt actuator which when operatively actuated causes the frame to tilt relative to the drill pipe, and the tilt actuator can be operatively actuated only when the grip hold actuator is not in the actuation condition.

48. The apparatus of claim 37 further comprising a spin actuator which when actuated causes a spinner to spin an upper pipe section relative to a lower pipe section, and the spin actuator can be operatively actuated only when the grip hold actuator is actuated.

49. A method of making a drill pipe joint having a top connection and a bottom connection, comprising:

providing a pipe make apparatus having top, middle and bottom wrenches;

gripping the bottom connection with the middle wrench in a gripping position;

gripping the top connection with the top wrench;

turning the top connection using the top wrench through a plurality of torquing extension cycles;

maintaining the middle wrench in the gripping position continuously throughout the plurality of torquing extension cycles; and before the plurality of torquing extension cycles, spinning the top connection to a shouldered or refusal position.

50. A method of making a drill pipe joint having a top connection and a bottom connection, comprising:

providing a pipe make apparatus having top, middle and bottom wrenches;

gripping the bottom connection with the middle wrench in a gripping position;

gripping the top connection with the top wrench;

turning the top connection using the top wrench through a plurality of torquing extension cycles, and maintaining the middle wrench in the gripping position continuously throughout the plurality of torquing extension cycles;

wherein the maintaining includes actuating a grip hold actuator.

51. The method of claim 50 wherein the grip hold actuator includes a detent button.

52. A method of making a drill pipe joint having a top connection and a bottom connection, comprising:

providing a pipe make apparatus having top, middle and bottom wrenches;

gripping the bottom connection with the middle wrench in a gripping position;

gripping the top connection with the top wrench;

turning the top connection using the top wrench through a plurality of torquing extension cycles, and maintaining the middle wrench in the gripping position continuously throughout the plurality of torquing extension cycles;

wherein the gripping the bottom connection includes actuating a grip hold actuator.

53. The method of claim 52 wherein the maintaining includes the grip hold actuator being a press-actuable detent button.

54. The method of claim 53 wherein the gripping includes operating a grip actuator with the detent button press actuated.

55. The method of claim 54 wherein the operating the grip actuator includes pushing a grip button.

56. The method of claim 55 wherein the plurality of torquing extension cycles includes extending and retracting a torque cylinder and a torque cylinder actuator operable only when the detent button is press actuated.

57. A method of making a drill pipe joint having a top connection and a bottom connection, comprising:

providing a pipe make apparatus having top, middle and bottom wrenches;

gripping the bottom connection with the middle wrench in a gripping position;

gripping the top connection with the top wrench;

turning the top connection using the top wrench through a plurality of torquing extension cycles, and maintaining the middle wrench in the gripping position continuously throughout the plurality of torquing extension cycles;

wherein the maintaining includes operating a grip hold actuator.

58. The method of claim 57 wherein the grip hold actuator is a detent button.

59. A pipe make or break apparatus, comprising:

a frame;

a first wrench connected to the frame and grippable on a lower pipe section;

a second wrench connected to the frame and grippable on an upper pipe section;

a torquing cylinder operatively connected between the first or second wrench and the frame;

with the first and second wrenches gripped on their respective pipe section and the torquing cylinder actuated, the upper pipe section is caused to turn relative to the lower pipe section in a drill pipe make or break operation; and an emergency stop actuator which when actuated blocks fluid flow to and from the rod and piston side ports of the torquing cylinder thereby automatically protectively locking the cylinder in its position;

wherein the emergency stop actuator includes a user-operable push button.

60. The apparatus of claim 59 further comprising a control panel supported by the frame and the push button is mounted on the control panel.

61. A pipe make or break apparatus, comprising:

a frame;

a first wrench connected to the frame and grippable on a lower pipe section;

a second wrench connected to the frame and grippable on an upper pipe section;

a torquing cylinder operatively connected between the first or second wrench and the frame;

with the first and second wrenches gripped on their respective pipe section and the torquing cylinder actuated, the upper pipe section is caused to turn relative to the lower pipe section in a drill pipe make or break operation;

an emergency stop actuator which when actuated blocks fluid flow to and from the rod and piston side ports of the torquing cylinder thereby automatically protectively locking the cylinder in its position; and user-operable push buttons for causing the first wrench to grip, the second wrench to grip and the torquing cylinder to be actuated.

62. A tubular make apparatus, comprising:

first, second and third jaws, the second jaw positioned between the first and third jaws;

with the apparatus in a make operation, the second and either the first or third jaw are operatively positioned on opposite first and second sides of a separation of a joint of a tubular;

a grip hold switch which when actuated in an actuated position by an operator of the apparatus and with the apparatus in the make operation, causes one of the second or either of the first or third jaws to grip on the tubular on one of the first and second sides of the separation;

a grip switch which when positioned in an actuated position by an operator of the apparatus, causes the other of the second or either of the first or third jaws to be held on the tubular on the other of the first and second sides of the separation continuously during the make operation, the grip switch being positionable in the actuated position only when the grip hold switch is in the actuated position;

a torquing cylinder for torquing the second jaw during multiple torquing cycles of the make operation; and a torque switch which when positioned in an actuated position by an operator of the apparatus causes the torquing cylinder to torque, the torque switch being positionable in the actuated position only when the grip hold switch is in the actuated position.

63. The apparatus of claim 62 further comprising: an operator's station for the apparatus and having a left side operatively accessible by a left hand of an operator at the station and a right side operatively accessible by a right hand of the operator; the torque switch being positioned at one of the left or right sides; and the grip switch being positioned at the other of the left or right sides.

64. The apparatus of claim 63 wherein the grip hold switch is positioned at the other of the left or right sides.

65. The apparatus of claim 62 wherein the torque switch is a spring-loaded button.

66. The apparatus of claim 62 wherein the grip hold switch is a detent button.

67. The apparatus of claim 62 wherein the grip switch is a spring-loaded button.

68. The apparatus of claim 62 further comprising a frame to which the jaws are connected and a raise/lower actuator which when operatively actuated causes the frame to raise or lower relative to a tubular, and the raise/lower actuator can be operatively actuated only when the grip hold switch is not in the actuated position.

69. The apparatus of claim 62 further comprising a frame to which the jaws are connected, and a tilt actuator which when operatively actuated causes the frame to tilt relative to the tubular, and the tilt actuator can be operatively actuated only when the grip hold switch is not in the actuated position.

70. The apparatus of claim 62 further comprising a spin actuator which when actuated causes a spinner to spin a first tubular part relative to a second tubular part, and the spin actuator can be operatively actuated only when the grip hold switch is in the actuated position.

71. The apparatus of claim 62 wherein the tubular is a drill pipe.

72. The apparatus of claim 62 wherein with the apparatus in a break operation, the second and the other of the first or third jaws are operatively positioned on opposite sides of a separation of a threaded joint of a tubular.

73. The apparatus of claim 62 further comprising an emergency stop switch which when actuated by an operator of the apparatus blocks fluid flow to and from rod and piston ports of the torquing cylinder thereby automatically protectively locking the torquing cylinder in its position.

74. The apparatus of claim 62 wherein the grip switch and the torque switch are adapted to be released at the same time.

75. The apparatus of claim 62 wherein when the torque switch is released from the actuated position the torquing cylinder is released to retract.

76. The apparatus of claim 62 wherein the first, second and third jaws are top, middle and bottom jaws, respectively, and the tubular is disposed upright.

77. The apparatus of claim 62 wherein the tubular is a drill pipe.

78. The apparatus of claim 62 wherein the first jaw is a top jaw, the second jaw is a middle jaw, and the third wrench is a bottom jaw, and with the apparatus in the make operation, the top jaw is on a bottom side of the separation of the joint of the tubular.

79. A tubular make/break apparatus, comprising:

first, second and third jaws, the second jaw being between the first and third jaws;

with the apparatus in a make operation, the second jaw and either the first or third jaw are operatively positioned on opposite first and second parts of a threaded joint of a tubular;

with the apparatus in a break operation, the second jaw and either the first or third jaw are operatively positioned on opposite first and second parts of a threaded joint of a tubular;

a selector switch selectively positionable by an operator of the apparatus in a make operation position and condition of the jaws and in an alternative break operation position and condition of the jaws; and a grip hold switch which when positioned in an actuated position by an operator of the apparatus, causes at least one of the jaws to be held on one of the first and second parts of the threaded joint of the tubular continuously between and during multiple torquing cycles during the make operation.

80. The apparatus of claim 79 wherein the grip hold switch is a detent button.

81. The apparatus of claim 79 further comprising a torquing cylinder operatively connected to the middle jaw for providing the torquing cycles.

82. The apparatus of claim 81 further comprising a torque switch which when actuated by an operator of the apparatus, controls the torquing of the torquing cylinder.

83. The apparatus of claim 81 further comprising first and second control panels, and wherein the torque switch is a spring-loaded button on the first control panel and the grip hold switch is a detent button on the second control panel.

84. The apparatus of claim 79 wherein the first, second and third jaws define top, middle and bottom jaws, respectively.

85. The apparatus of claim 79 wherein the tubular is a drill pipe.

86. The apparatus of claim 79 further comprising a grip switch which when actuated by an operator of the apparatus causes one of the jaws to grip onto a part of a threaded joint of a tubular.

87. The apparatus of claim 86 wherein the grip switch can be actuated only when the grip hold switch is in the actuated position.

88. The apparatus of claim 79 further comprising a grip-torque switching assembly actuable by an operator of the apparatus and to provide the multiple torquing cycles.

89. The apparatus of claim 88 wherein the grip-torque switching assembly includes a grip switch and a torque switch.

90. A tubular make/break apparatus, comprising:

top, middle and bottom wrenches;

with the apparatus in one of a break or a make position, the middle and bottom wrenches are operatively positioned on opposite top and bottom portions of a threaded connection of a tubular;

with the apparatus in the other of the break or make position, the top and middle wrenches are operatively positioned on opposite top and bottom portions of a threaded connection of a tubular;

grip hold means which when actuated and with the apparatus in the make position, for causing at least one of the wrenches to be held on the bottom portion of the threaded connection continuously between and during multiple torquing cycles during a make operation, the grip hold means when deactuated at an end of the make operation causes the at least one of the wrenches to be released from the bottom portion of the threaded connection;

a torquing cylinder connected to the middle wrench and which provides the torquing cycles; and an emergency stop switch which when actuated by an operator of the apparatus causes fluid flow to and from rod and piston ports of the torquing cylinder to be blocked thereby automatically protectively locking the cylinder in its position.

91. The apparatus of claim 90 wherein the grip hold means includes a grip hold switch actuable by an operator of the apparatus.

92. The apparatus of claim 91 wherein the grip hold switch is a detent button.

93. The apparatus of claim 90 further comprising grip means which when actuated by an operator of the apparatus in the make position, for causing one of the wrenches to grip onto the tubular during a torquing step of the multiple torquing cycles.

94. The apparatus of claim 93 wherein the grip means includes a grip-torque actuator assembly.

95. The apparatus of claim 94 wherein the grip-torque actuator assembly includes a torque switch and a grip switch.

96. The apparatus of claim 94 wherein the grip means includes a spring-loaded button.

97. The apparatus of claim 90 wherein the tubular is a drill pipe.

98. A tubular make apparatus, comprising:

first, second and third jaws, the second jaw positioned between the first and third jaws;

with the apparatus in a make operation, the second and either the first or third jaw are operatively positioned on opposite first and second sides of a separation of a joint of a tubular;

a grip switch which when actuated by an operator of the apparatus and with the apparatus in the make operation, causes one of the second or either of the first or third jaws to grip on the tubular on one of the first and second sides of the separation;

a grip hold switch which when positioned in an actuated position by an operator of the apparatus, causes the other of the second or either of the first or third jaws to be held on the tubular on the other of the first and second sides of the separation continuously during the make operation;

a frame to which the jaws are connected; and a tilt actuator which when operatively actuated causes the frame to tilt relative to the tubular, and the tilt actuator can be operatively actuated only when the grip hold switch is not in the actuated position.

99. The apparatus of claim 98 wherein the make operation includes multiple torquing cycles, and further comprising a torquing cylinder for torquing one of the jaws during the multiple torquing cycles.

100. The apparatus of claim 98 wherein with the apparatus in a break operation, the second and the other of the first or third jaws are operatively positioned on opposite sides of a separation of a joint of a tubular.

101. The apparatus of claim 98 wherein the grip switch can be actuated only when the grip hold switch is in the actuated position.

102. The apparatus of claim 98 wherein the grip hold switch is a detent button.

103. The apparatus of claim 98 wherein the grip switch is a spring-loaded button.

104. The apparatus of claim 98 further comprising a frame to which the jaws are connected and a raise/lower actuator which when operatively actuated causes the frame to raise or lower relative to a tubular, and the raise/lower actuator can be operatively actuated only when the grip hold switch is not in the actuated position.

105. The apparatus of claim 98 further comprising a spin actuator which when actuated causes a spinner to spin a first tubular part relative to a second tubular part, and the spin actuator can be operatively actuated only when the grip hold switch is in the actuated position.

106. The apparatus of claim 98 wherein the tubular is a drill pipe.

107. A tubular make apparatus, comprising:

first, second and third jaws, the second jaw positioned between the first and third jaws;

with the apparatus in a make operation, the second and either the first or third jaw are operatively positioned on opposite first and second sides of a separation of a joint of a tubular;

a grip switch which when actuated by an operator of the apparatus and with the apparatus in the make operation, causes one of the second or either of the first or third jaws to grip on the tubular on one of the first and second sides of the separation;

a grip hold switch which when positioned in an actuated position by an operator of the apparatus, causes the other of the second or either of the first or third jaws to be held on the tubular on the other of the first and second sides of the separation continuously during the make operation;

a spin actuator which when actuated causes a spinner to spin a first tubular part relative to a second tubular part; and the spin actuator can be operatively actuated only when the grip hold switch is in the actuated position.

108. The apparatus of claim 107 wherein the make operation includes multiple torquing cycles, and further comprising a torquing cylinder for torquing one of the jaws during the multiple torquing cycles.

109. The apparatus of claim 107 wherein the spin actuator is a button.

110. The apparatus of claim 107 wherein with the apparatus in a break operation, the second and the other of the first or third jaws are operatively positioned on opposite sides of a separation of a joint of a tubular.

111. The apparatus of claim 107 wherein the grip switch can be actuated only when the grip hold switch is in the actuated position.

112. The apparatus of claim 107 wherein the grip hold switch is a detent button.

113. The apparatus of claim 107 wherein the grip switch is a spring-loaded button.

114. The apparatus of claim 107 further comprising a frame to which the jaws are connected and a raise/lower actuator which when operatively actuated causes the frame to raise or lower relative to a tubular, and the raise/lower actuator can be operatively actuated only when the grip hold switch is not in the actuated position.

115. The apparatus of claim 107 further comprising a frame to which the jaws are connected, and a tilt actuator which when operatively actuated causes the frame to tilt relative to the tubular, and the tilt actuator can be operatively actuated only when the grip hold switch is not in the actuated position.

116. The apparatus of claim 107 wherein the tubular is a drill pipe.

117. A tubular make or break apparatus, comprising:

a frame;

first, second and third wrenches connected to the frame;

a torquing cylinder operatively connected between the second wrench and the frame, the torquing cylinder having rod and piston ports;

with the first or third wrench and the second wrench gripped on respective first and second portions of a threaded section of a tubular and the torquing cylinder actuated, one of the first and second portions of the threaded section is caused to turn relative to the other of the first and second portions of the threaded section in a make or break operation; and an emergency stop switch which when actuated by an operator of the apparatus blocks fluid flow to and from the rod and piston ports thereby automatically protectively locking the torquing cylinder in its position.

118. The apparatus of claim 117 wherein the tubular is a drill pipe.

119. The apparatus of claim 117 wherein the first, second and third wrenches are top, middle and bottom wrenches, respectively.

120. The apparatus of claim 117 further comprising a grip hold switch which when positioned in an actuated position by an operator of the apparatus, causes at least one of the wrenches to be held on one of the first and second portions continuously between and during multiple torquing cycles of the torquing cylinder during the make operation.

121. The apparatus of claim 117 wherein the emergency stop switch is an operator-actuable button.

122. The apparatus of claim 117 comprising a selector switch selectively positionable by an operator of the apparatus in a make operation position and in an alternative break operation position.

123. A tubular make apparatus, comprising:

first, second and third jaws, the second jaw positioned between the first and third jaws;

with the apparatus in a make operation, the second and either the first or third jaw are operatively positioned on opposite first and second sides of a separation of a joint of a tubular;

one of the second and either the first or third jaw defines a hold jaw, and the other of the second and either the first or third jaw defines a grip jaw;

grip hold means for causing with the apparatus in the make operation, the hold jaw to be held on the tubular on the second side of the separation in a grip-hold position continuously during multiple torquing cycles of the make operation; and grip means for causing, with the apparatus in the make operation, the grip jaw to grip on the tubular on the first side of the separation, torque the tubular, and release the tubular through the multiple torquing cycles during the make operation, the grip means can be actuated only when the hold jaw is in the grip-hold position.

124. The apparatus of claim 123 wherein the grip means includes a grip switch actuable by an operator of the apparatus.

125. The apparatus of claim 124 wherein the grip means includes a torque switch actuable by the operator.

126. The apparatus of claim 125 wherein the grip switch and the torque switch are positioned on opposite sides of an operator's station of the apparatus.

127. The apparatus of claim 126 wherein the grip switch and the torque switch are each a spring-loaded button.

128. The apparatus of claim 126 wherein the grip hold means includes a grip-hold detent button.

129. The apparatus of claim 123 wherein the grip means includes a torquing cylinder for torquing the second jaw during the multiple torquing cycles.

130. The apparatus of claim 126 wherein the grip hold means includes a detent button.

131. The apparatus of claim 126 wherein the grip means includes a spring-loaded grip button.

132. The apparatus of claim 123 further comprising a frame to which the jaws are connected and a raise/lower actuator which when operatively actuated causes the frame to raise or lower relative to a tubular, and the raise/lower actuator can be operatively actuated only when the grip hold means is not in an actuated condition.

133. The apparatus of claim 123 further comprising a frame to which the jaws are connected, and a tilt actuator which when operatively actuated causes the frame to tilt relative to the tubular, and the tilt actuator can be operatively actuated only when the grip hold means is not in an actuated condition.

134. The apparatus of claim 123 further comprising a spin actuator which when actuated causes a spinner to spin a first tubular part relative to a second tubular part, and the spin actuator can be operatively actuated only when the grip hold means is in an actuated condition.

135. The apparatus of claim 123 wherein the tubular is a drill pipe.

136. The apparatus of claim 123 wherein the first, second and third jaws define top, middle and lower jaws, respectively.

137. The apparatus of claim 123 wherein the grip hold means includes a hydraulic circuit.

138. The apparatus of claim 123 wherein the grip means includes a hydraulic circuit.

139. The apparatus of claim 123 wherein the grip means includes a grip-torque switching assembly.

140. The apparatus of claim 139 wherein the grip-torque switching assembly includes a grip switch and a hold switch.

141. A method of making a tubular, comprising:

providing a tubular make apparatus including first, second and third jaws connected to a frame, the second jaw being positioned between the first and third jaws;

positioning the apparatus in a make position with the second and either the first or third jaw operatively positioned on opposite first and second sides of a separation of a joint of a tubular;

one of the second and either the first or third jaw defining a grip hold jaw, and the other of the second and either the first or third jaw defining a grip jaw;

with the apparatus in the make position, gripping the hold jaw on the tubular on the first side of the separation in a hold position;

with the grip hold jaw in the hold position, gripping the grip jaw on the second side of the separation, torquing the grip jaw and releasing the grip jaw through multiple torquing cycles during a make operation on the tubular; and maintaining the grip hold jaw in the hold position continuously during and between the multiple torquing cycles by actuating a grip hold switch at a start of the multiple torquing cycles.

142. The method of claim 141 wherein the positioning the apparatus in the make position includes moving a selector switch from a break position to a make position.

143. The method of claim 142 wherein the selector switch and the grip-hold switch are on the same side of an operator's station of the apparatus.

144. The method of claim 143 wherein the gripping the grip jaw includes pressing a spring-loaded grip button.

145. The method of claim 144 wherein the releasing the grip jaw includes releasing the spring-loaded grip button.

146. The method of claim 144 wherein the torquing includes pressing a spring-loaded torque button.

147. The method of claim 146 wherein the grip button and the torque are positioned on opposite sides of an operator's station of the apparatus.

148. The method of claim 144 wherein the tubular is a drill pipe.

149. The method of claim 144 wherein the grip hold switch is a grip-hold detent button, and the actuating includes pressing the grip-hold detent button.

150. The method of claim 144 wherein the gripping and the torquing include actuating a grip-hold actuator assembly.

151. The method of claim 150 wherein the grip-hold actuator assembly includes a grip switch and a torque switch.

152. A method of making a tubular, comprising:

providing a tubular make apparatus including (a) a frame, (b) first, second and third jaws connected to the frame, the second jaw being positioned between the first and third jaws, and (c) a torquing cylinder adapted to torque the second jaw, the torquing cylinder having rod and piston ports;

positioning the apparatus in a make position with the first or third jaws operatively positioned on a first side of a separation of a joint of a tubular and the second jaw operatively positioned on an opposite second side of the separation; and causing fluid flow to and from the rod and piston ports to be blocked to thereby protectively lock the torquing cylinder in its position.

153. The method of claim 152 wherein the causing includes actuating an emergency stop switch.

154. The method of claim 153 wherein the emergency stop switch is a button, and the actuating includes pushing the button.

155. The method of claim 152 wherein the causing is during an emergency situation of the apparatus.

156. The method of claim 152 wherein the tubular is a drill pipe.

* * * * *